US008364062B2

(12) United States Patent
Kamoshida et al.

(10) Patent No.: US 8,364,062 B2
(45) Date of Patent: Jan. 29, 2013

(54) FIXING ROLLER FOR FIXING UNIT, FIXING UNIT, IMAGE FORMING APPARATUS, ROLLER REPLACEMENT AID FOR FIXING UNIT, AND METHOD OF REPLACING FIXING ROLLER IN FIXING UNIT

(75) Inventors: Chiharu Kamoshida, Ibaraki (JP); Sho Sawahata, Ibaraki (JP); Genichiro Kawamichi, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 158 days.

(21) Appl. No.: 12/805,724

(22) Filed: Aug. 17, 2010

(65) Prior Publication Data

US 2011/0052258 A1 Mar. 3, 2011

(30) Foreign Application Priority Data

Aug. 31, 2009 (JP) ..... 2009-199997

(51) Int. Cl.
*G03G 15/16* (2006.01)

(52) U.S. Cl. ..... 399/122

(58) Field of Classification Search ..... 399/109, 399/110, 122, 320, 330, 331
See application file for complete search history.

(56) References Cited

U.S. PATENT DOCUMENTS

| | | | | |
|---|---|---|---|---|
| 5,583,624 | A * | 12/1996 | Heigl | 399/122 |
| 6,442,360 | B1 * | 8/2002 | Onodera et al. | 399/122 |
| 2008/0317521 | A1 | 12/2008 | Inoue et al. | |
| 2010/0172671 | A1 * | 7/2010 | Onodera et al. | 399/122 |

FOREIGN PATENT DOCUMENTS

| | | |
|---|---|---|
| DE | 42 09 520 | 4/1993 |
| DE | 100 56 939 | 6/2001 |
| EP | 1 748 321 | 1/2007 |
| EP | 2 207 065 | 7/2010 |
| JP | 05-504633 | 7/1993 |
| JP | 07-504961 | 6/1995 |
| JP | 2004-219491 | 8/2004 |
| JP | 3900403 | 1/2007 |
| JP | 4473079 | 3/2010 |
| JP | 2010-181858 | 8/2010 |
| JP | 2010-237508 | 10/2010 |

OTHER PUBLICATIONS

European Search Report dated Oct. 12, 2011.
English Language Abstract of JP 2005-111979 dated Apr. 28, 2005.
English Language Abstract of JP 2002-278336 dated Sep. 27, 2002.
English Language Abstract of WO 91/09351 dated Jun. 27, 1991.
English Language Abstract of WO 93/19401 dated Sep. 30, 1993.
Notification of Registration and Notification of Allowance for corresponding Chinese patent application No. 201010268598.4 dated Aug. 2, 2012 (with English translation).

* cited by examiner

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

In a fixing unit in which at least one of a heating roller and a pressing roller is provided as a fixing roller and is replaceably supported along the axial direction of the fixing roller, a sliding member is formed integrally to the inside of the fixing roller, so that the sliding member slides on the outer circumference of a roller guiding shaft upon replacing the fixing roller.

20 Claims, 20 Drawing Sheets

FIXING ROLLER FOR FIXING UNIT, FIXING UNIT, IMAGE FORMING APPARATUS, ROLLER REPLACEMENT AID FOR FIXING UNIT, AND METHOD OF REPLACING FIXING ROLLER IN FIXING UNIT

CROSS-REFERENCE TO RELATED APPLICATIONS

The present application claims priority to and incorporates by reference the entire contents of Japanese Patent Application No. 2009-199997 filed in Japan on Aug. 31, 2009.

BACKGROUND OF THE INVENTION

1. Field of the Invention

The present invention relates to fixing roller for fixing unit, fixing unit, image forming apparatus, roller replacement aid for fixing unit, and method of replacing fixing roller in fixing unit.

2. Description of the Related Art

A known fixing unit for an image forming apparatus such as a laser beam printer or a copying machine, conveys a recording medium carrying a toner image, which is not yet fixed on a surface thereof, while being nipped between a heating roller and a pressing roller to apply heat and pressure and fixes the toner image onto the recording medium.

A plurality of heater lamps as heat sources is arranged inside the heating roller. Generally, an image forming apparatus that provides higher printing speed or that supports larger ream weight requires larger thermal capacity for fixing of toner images. In such an apparatus, it is necessary to keep the heating roller at a certain temperature or higher. This results in an increase in fixing temperature.

When such a heating roller that has kept at high temperature ends its life and is to be replaced, the operation performed by the image forming apparatus must be stopped, and the heating roller must be then cooled down to a temperature at which it can be replaced. Subsequently, a servicing engineer removes the heating roller from the fixing unit to replace the heating roller with a new one. Because the heating roller requires a long time to cool down, the replacement task is very inefficient. Furthermore, because the image forming apparatus is kept out of service over an extended time period, not only the productivity of the image forming apparatus is reduced but also the cost for replacement and maintenance tasks would be high.

In recent years, because an image forming apparatus is required to provide high speed printing, to achieve high image quality, and to support different types of paper, different types of heating rollers need to be incorporated in the fixing unit. For high speed printing, a heating roller with a surface layer coated by a thin coat of tetrafluoroethylene-perfluoro alkyl vinyl ether copolymer (PFA) resin is used to speed up supply of heat required for fixing toner images. For high image quality, a heating roller with a surface layer covered by silicone rubber, for example, is used to minimize smudge or bleeding during fixing of toner images. When durability of the heating roller is required while keeping a certain level of image quality, a heating roller with a silicone rubber layer covered by a PFA tube, for example, is used.

To satisfy such needs with a single image forming apparatus, a heating roller must be replaced with one that fits the need. The heating roller basically has a large thermal capacity while there are some differences depending on types of heating rollers, and it takes quite a long time for the heating roller, which has been kept at a high-temperature for supplying a heat amount required to optimally fix toner images, to cool down so that the heating roller can be replaced.

Japanese Patent Application Laid-open No. H5-504633 discloses an example of how a heating roller is replaced. FIG. 24 is a partial sectional view of a fixing unit disclosed in Japanese Patent Application Laid-open No. H5-504633, and FIG. 25 is a perspective view of the fixing unit with a heating roller included therein being replaced.

As illustrated in FIG. 24, one end of this heating roller 100 is supported by a frame 102 via a supporting flange 101. The supporting flange 101 has a shaft bearing 103. The shaft bearing 103 and a centering member 104 are fitted into an opening end of the heating roller 100. The other end of the heating roller 100 is similarly supported by a supporting flange via a shaft bearing, although not illustrated.

The supporting flange 101 is fixed to the frame 102 by way of a thumbscrew 106. A holding claw 108 is fixed in the supporting flange 101 via a thumbscrew 107. The holding claw 108 functions to fix the heating roller 100 while the heating roller 100 is being replaced.

A plurality of radiator modules 105 is arranged inside the heating roller 100. One end of each of the radiator modules 105 is held at the center of the supporting flange 101 via a holding member 109. Although not illustrated, the other end of each of the radiator modules 105 is similarly held on the supporting flange indirectly via a holding member.

As illustrated in FIG. 24, a connector 110 provided to an end of each of the radiator modules 105 protrudes from the supporting flange 101 with the radiator modules 105 being held at the center of the supporting flange 101. A grip 111 for replacing the heating roller 100 is integrated with the supporting flange 101. The grip 111 is arranged so as to straddle the connector 110 provided to the radiator modules 105 protruding from the supporting flange 101.

To replace the heating roller 100, the thumbscrew 106 is loosened, and the heating roller 100 is pulled out of the frame 102 together with the supporting flange 101 and other components by holding the grip 111 with one hand as illustrated in FIG. 25. Felt 130 is pasted on the outer circumference of the opening of the frame 102 to prevent the heating roller 100 from being damaged because of contact with the frame 102 upon passing through the opening of the frame 102.

The heating roller used in this type of fixing unit is cylindrical in shape, with a diameter of approximately 100 millimeters and a length of 500 millimeters or longer, and is quite heavy. Under such conditions, in the fixing unit disclosed in Japanese Patent Application Laid-open No. H5-504633, inserting and removing operations could be unstable due to the weight and the heat of the heating roller 100 and other components when the heating roller 100 is pulled out together with the supporting flange 101 and the like from the frame 102 by holding the grip 111 with one hand and supporting the heating roller 100 with the other hand wearing a glove 120. The surface of the heating roller 100 may be damaged as a result of coming in contact with other components such as the frame 102 while the heating roller 100 is being replaced.

Because positioning of the heating roller 100 is unstable and no aid is available to stabilize the positioning of the heating roller 100, the heating roller 100 is supported with a hand wearing the glove 120 during the replacement in an embodiment disclosed in Japanese Patent Application Laid-open No. H5-504633. However, there is some operability problems in that, for example, the hand could get burnt if it touches the heating roller 100 in a high-temperature condition, or parting agent or lubricant attached on the heating roller 100 could smear the glove 120.

In addition, because the roller surface may be damaged as a result of the heating roller 100 coming in contact with the frame 102 while being pulled out together with the supporting flange 101 and other components from the frame 102 by holding the grip 111 with one hand, the felt 130 is pasted around the opening of the frame 102 to protect against the damage. However, swear could be accumulated on the felt 130 because the heating roller 100 with parting agent or lubricant attached is slid over the felt 130. Therefore, the felt 130 is insufficient as a protection of the surface on the heating roller 100.

Furthermore, because the felt 130 must be pasted or peeled off every time the heating roller 100 is replaced, the replacement operation becomes cumbersome. Moreover, because the felt 130 becomes dirty every time the heating roller 100 is replaced, it is necessary to discard the dirty felt 130 and get new felt 130 ready.

SUMMARY OF THE INVENTION

It is an object of the present invention to at least partially solve the problems in the conventional technology.

According to an aspect of the present invention, there is provided a fixing roller used for a fixing unit that has a heating roller and a pressing roller arranged pressably against the heating roller, and heats and presses a recording medium that holds an unfixed toner image on a surface thereof while nipping and conveying the recording medium between the heating roller and the pressing roller to thereby fix a toner image onto the recording medium, wherein the fixing roller is at least one of the heating roller and the pressing roller that is replaceably supported in the fixing unit along an axial direction of the fixing roller, and the fixing roller includes a sliding member that is formed integrally to an inside of the fixing roller and slides on an outer circumference of a roller guiding shaft that is inserted into and removed from the fixing roller upon replacing the fixing roller.

According to another aspect of the present invention, there is provided a roller replacement aid for a fixing unit, in which at least one of a heating roller and a pressing roller arranged pressably against the heating roller is provided as a fixing roller and is replaced by being pulled out along an axial direction, the roller replacement aid includes: a roller guiding shaft that is removably attached to the fixing unit to penetrate through a sliding member provided inside of the fixing roller to be replaced, and has an outer circumference on which the sliding member slides upon inserting and removing the fixing roller; and an assisting unit that is removably attached to an assisting unit connecting member arranged to a leading edge portion of the roller to be replaced in a removal direction, and fitted onto an end of the roller guiding shaft to allow the fixing roller to be inserted and removed.

According to still another aspect of the present invention, there is provided a method of replacing a fixing roller in a fixing unit in which at least one of a heating roller and a pressing roller arranged pressably against the heating roller is provided as a fixing roller and is replaced by being pulled out along an axial direction thereof, the method includes: inserting a roller guiding shaft to be mounted so as to penetrate through a sliding member arranged inside of the fixing roller to be replaced; pulling out a holding member, which has a shaft bearing rotatably supporting one end of the fixing roller to be replaced, along the roller guiding shaft; connecting an assisting unit to an assisting unit connecting member arranged to a leading edge of the fixing roller in a removal direction, by inserting the assisting unit along the roller guiding shaft; pulling out the fixing roller connected to the assisting unit by allowing the fixing roller to slide on an outer circumference of the roller guiding shaft via the sliding member; connecting the assisting unit to an assisting unit connecting member of a new roller in order to mount the new roller to which the assisting unit is connected, by allowing the new roller to slide on the outer circumference of the roller guiding shaft via the sliding member; pulling out the assisting unit along the roller guiding shaft with disconnecting the assisting unit from the new roller thus mounted; mounting a holding member, which has a shaft bearing rotatably supporting one end of the new roller, along the roller guiding shaft; and pulling out the mounted roller guiding shaft.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT(S)

Exemplary embodiments according to the present invention are described below in detail with reference to accompanying drawings.

<Overall Structure of Laser Beam Printer>

To begin with, an overall structure of an electrophotographic laser beam printer applying the present invention will be explained with reference to FIG. 23.

Figure 23:
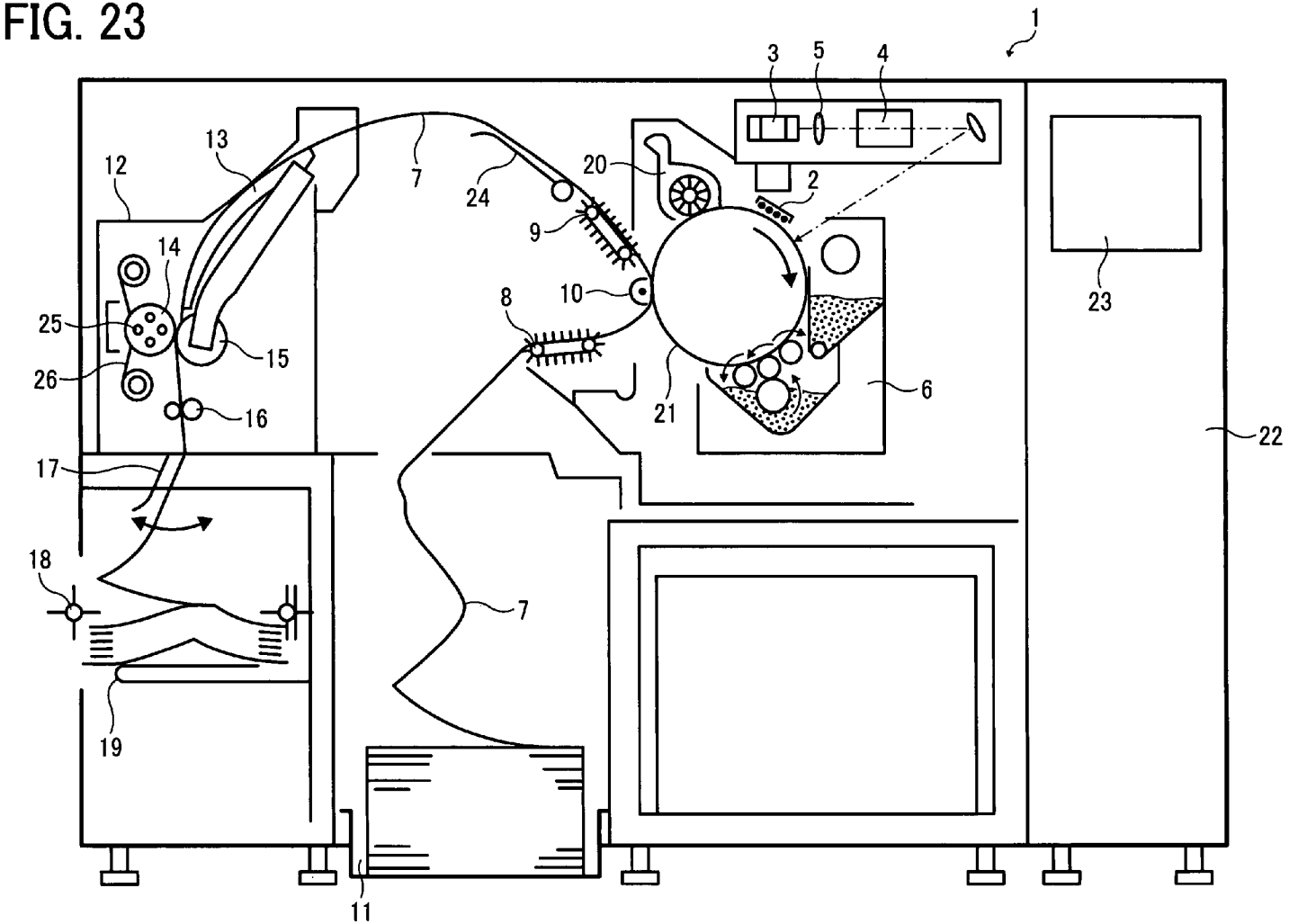
FIG. 23 is a schematic of an image forming apparatus according to an embodiment of the present invention.
Figure 24:
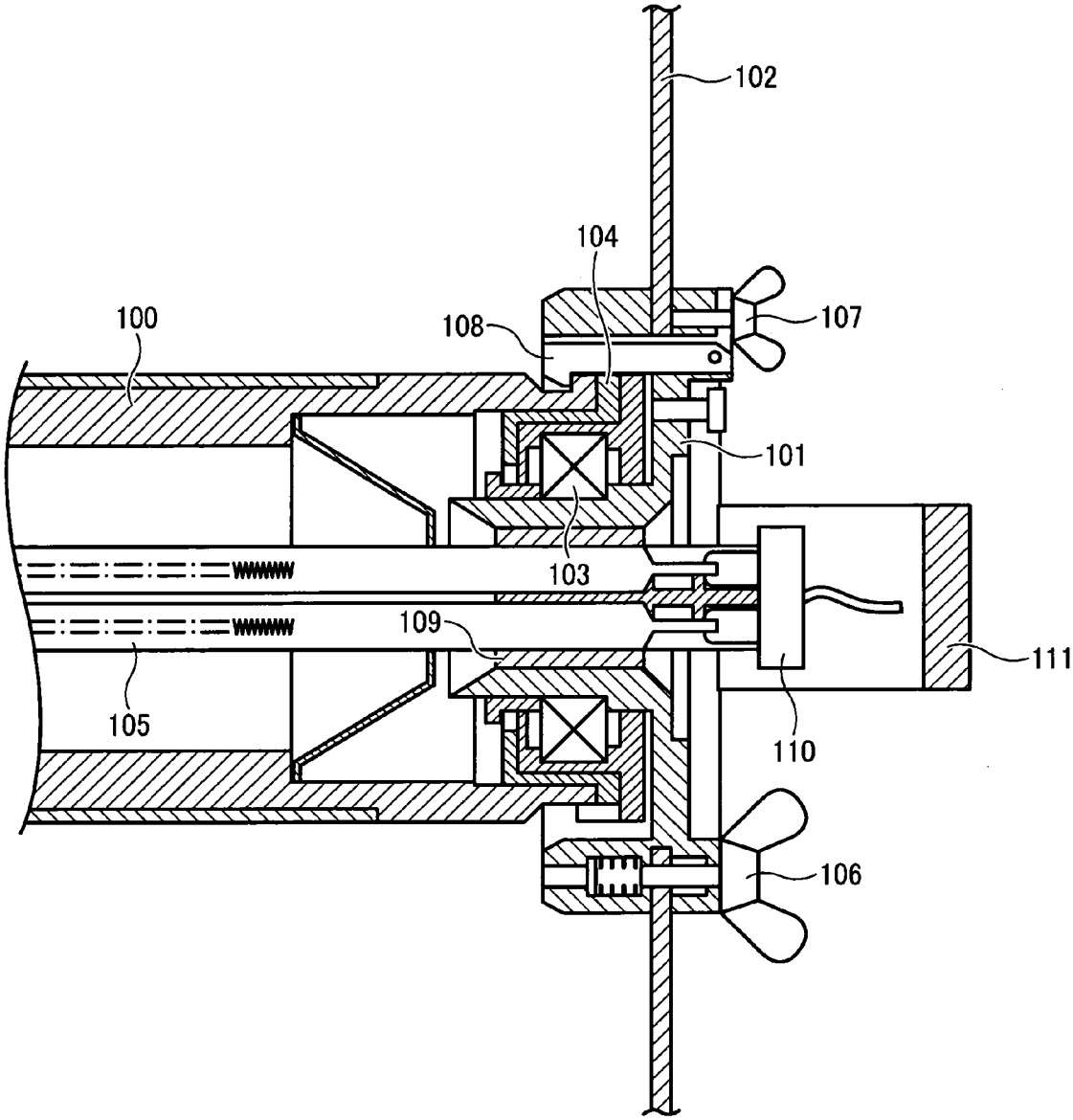
FIG. 24 is a partial sectional view of a conventional fixing unit.
Figure 25:
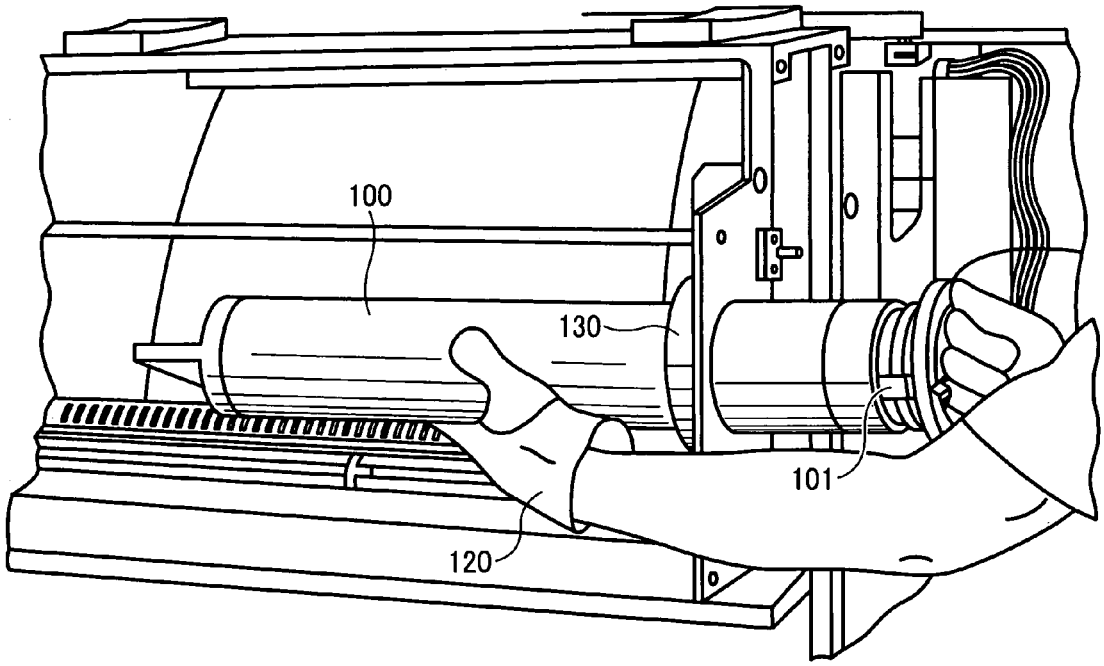
FIG. 25 is a perspective view of the fixing unit when a heating roller included therein is replaced.

In FIG. 23, in a laser beam printer 1, a photosensitive drum 21 rotates in a direction of the arrow based on a print operation starting signal issued by a controller 22. The photosensitive drum 21 rotates at a speed corresponding to the printing speed of the laser beam printer 1, and keeps rotating until the printing operation is ended. When the photosensitive drum 21 starts to rotate, a high voltage is applied to a corona charger 2 to and the surface of the photosensitive drum 21 is evenly charged with a positive charge, for example.

A rotating polygonal mirror 3 starts rotating immediately after the laser beam printer 1 is powered on, and keeps rotating at a constant speed with high accuracy while the power is kept on. Light output from a light source 4, such as a semiconductor laser, is reflected on the rotating polygonal mirror 3, and scans and irradiates a surface of the photosensitive drum 21 via an fθ lens 5. When character data or graphic data converted into a dot image is sent from the controller 22 to the laser beam printer 1 as ON/OFF signals for the laser beam, areas irradiated and not irradiated with the laser beam are created on the surface of the photosensitive drum 21, forming a so-called electrostatic latent image.

When the area of the photosensitive drum 21 carrying the electrostatic latent image arrives at a position facing to a developing unit 6, toner is supplied to the electrostatic latent image. The toner charged with a positive charge, for example, is attracted by a static electricity to an area of the photosensitive drum 21, where electric charge is disappeared due to the irradiation of the laser beam, and creates a toner image on the photosensitive drum 21.

A paper conveying tractor 8 conveys continuous paper (recording medium) 7 stored in a paper hopper 11 toward the area between the photosensitive drum 21 and a transferring unit 10 in synchronization with a timing the toner image formed on the photosensitive drum 21 arrives at a transfer position. The toner image formed on the photosensitive drum 21 is sucked onto the paper 7 by the effect of the transferring unit 10 applying a charge, the polarity of which is opposite to that of the toner image, to the rear side of the paper 7.

In this manner, the paper 7 is conveyed to a fixing unit 12 via the paper conveying tractor 8, the transferring unit 10, a paper conveying tractor 9, and a buffering plate 24. The paper 7 that has arrived at the fixing unit 12 is pre-heated by a preheater 13 incorporating a plurality of heaters, then nipped and conveyed while heated and pressed by a nipping portion, which is formed by a pair of fixing rollers composed of a heating roller 14 incorporating a plurality of heater lamps 25 and a pressing roller 15. In this manner, the toner image is fused and fixed to the paper 7.

The paper 7 sent out from the heating roller 14 and the pressing roller 15 is ejected to a stacker table 19 by paper ejecting rollers 16, and folded along perforations alternately by swinging of a swing fin 17. While a rotating puddle 18 straightens the folds, the paper 7 is stacked in the stacker table 19. The area of the photosensitive drum 21 passed over the transfer position is cleaned by a cleaner 20, and is prepared for the next printing operation.

The buffering plate 24 is provided to absorb a slack or a tension of the paper 7 that are caused when a speed difference in paper conveyance occurs between the paper conveying tractor 9 and the fixing rollers (the heating roller 14 and the pressing roller 15). A display monitor 23 displays thereon information based on a status of the laser beam printer 1 executing a printing operation. A web member 26 is arranged contactable to and woundable on the surface of the heating roller 14, and applies a parting agent or a lubricant to the surface of the heating roller 14.

<Structure Around Heating Roller>

A structure around the heating roller 14 included in the fixing unit 12 will be explained with reference to FIG. 16. The heating roller 14 includes a base pipe 14*a* made from metal such as aluminum, and a surface layer 14*b* disposed on a paper-passing area Aw around the base pipe 14*a*. The surface layer 14*b* is made of a coating, for example, such as tetrafluoroethylene-perfluoro alkyl vinyl ether copolymer (PFA) resin, a silicone rubber layer, or a silicon rubber layer and a PFA tube covering thereabove.

Heat release preventing members (hereinafter, "absorbers") 14*c* and 14*d* disk-shaped and made of aluminum, for example, are fixed on the inside of the heating roller 14 near openings at both ends, respectively. The absorbers 14*c* and 14*d* prevent radiant heat, which is from the heater lamps 25 in the heating roller 14, from releasing to outside of the heating roller 14 and prevent the temperature inside the machine from rising.

Figure 16:
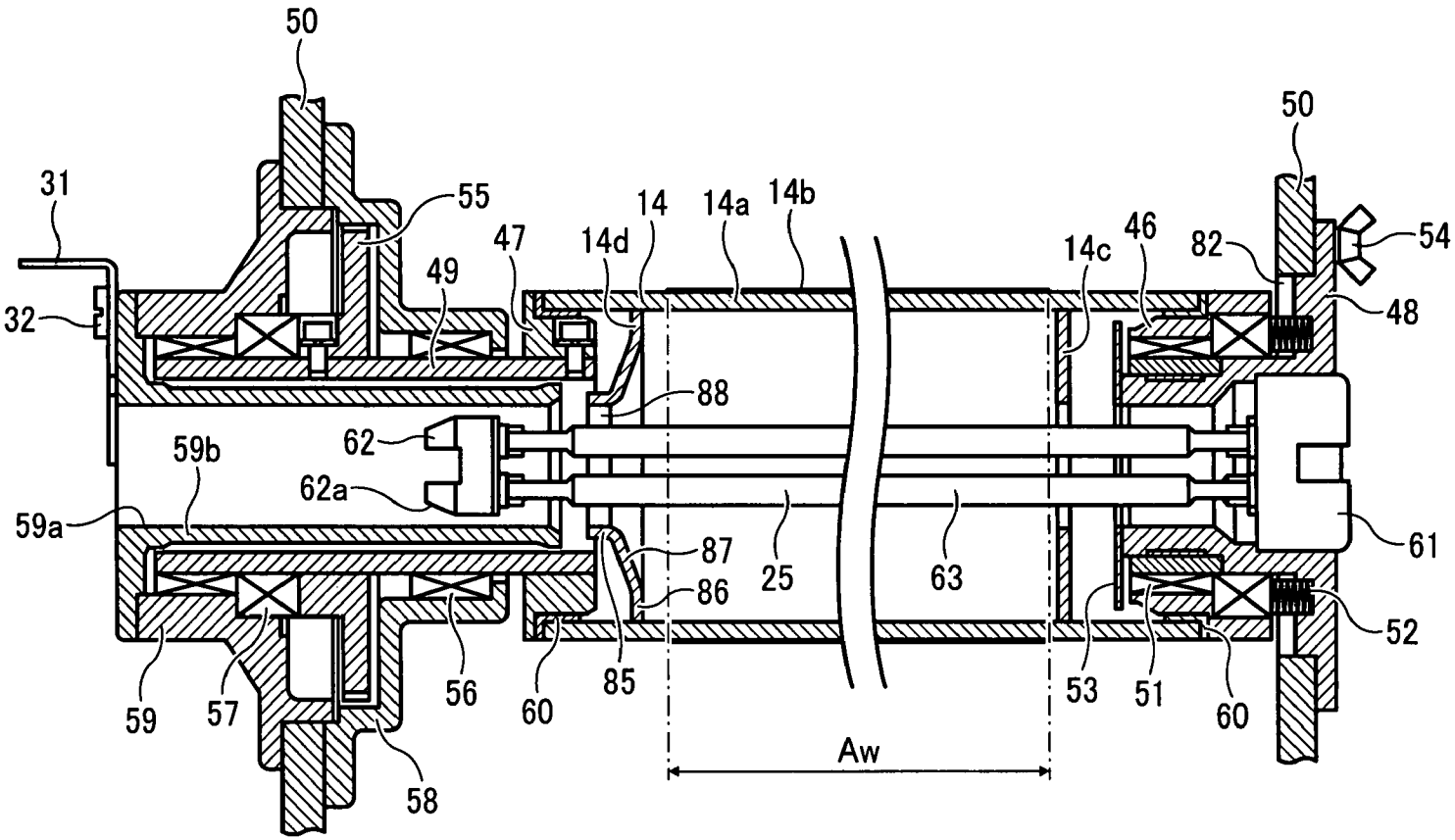
FIG. 16 is a sectional view around the heating roller according to the embodiment.

As illustrated in FIG. 16, the absorbers 14*c* and 14*d* are disposed slightly outside of the paper-passing area Aw of the heating roller 14. In other words, the distance between the absorber 14*c* and the absorber 14*d* is slightly longer than the length of the paper-passing area Aw in the axial direction. The length of each of the heater lamps 25 is slightly longer than the distance between the absorber 14*c* and the absorber 14*d*.

If the entire or a part of the absorbers 14*c* and 14*d* are placed in the paper-passing area Aw of the heating roller 14, the absorbers 14*c* and 14*d* may obstruct transfer of the radiant heat from the heater lamps 25, thus the surface of the heating roller 14 may not reach a desired temperature. Therefore, the absorbers 14*c* and 14*d* are arranged so as not to enter the paper-passing area Aw of the heating roller 14.

Both ends of the heating roller 14 are supported by frames 50 and 50 of the fixing unit, respectively, via holding members 48 and 49 respectively having centering members 46 and 47.

The centering member 46 is arranged on the holding member 48 via a shaft bearing 51, and is inserted to the inside of one opening end of the heating roller 14. The shaft bearing 51 can absorb thermal expansions of the heating roller 14 and variations in supporting members therearound by a plurality of springs 52 arranged along the circumferential direction and a stopper plate 53 attached on an inner end surface of the holding member 48. When the holding member 48 is incorporated in the heating roller 14, the springs 52 are slightly compressed and a gap is formed between the centering member 46 and the shaft bearing 51, and the stopper plate 53 as illustrated in FIG. 16. The holding member 48 is fastened to one of the frames 50 by a plurality of thumbscrews 54.

The holding member 49 is provided with a gear 55 that receives a driving force from a heating roller driving motor (not illustrated) that rotates the heating roller 14. The holding member 49 is rotatably supported by housings 58 and 59 via shaft bearings 56 and 57, respectively.

A key groove (not illustrated) extending in the axial direction is formed on an opening end of the heating roller 14 facing to the centering member 47. A key (not illustrated) engaged into the key groove is formed on an end of the centering member 47. The heating roller 14 and the centering member 47 are coupled by these key structures. Therefore, the driving force of the heating roller driving motor is transferred to the heating roller 14 via the gear 55, the holding member 49, the centering member 47, and the key structures, to rotate the heating roller 14 in a predetermined direction.

A ring 60 made of heat tolerant synthetic resin is interposed between each end of the heating roller 14 and each of the centering members 46 and 47 to prevent the heat on the heating roller 14 from leaking to the centering members 46 and 47, and to prevent damage. A groove-like cutout (not illustrated) is formed on the ring 60 on the centering member 47 side at a position corresponding to the key groove on the heating roller 14, so that the key can be engaged into the key groove.

The heater lamps 25 as the heat source of the heating roller 14 are bundled with lamp holders 61 and 62, respectively holding both ends of the heater lamps 25, to form a lamp cartridge 63. The lamp cartridge 63 is installed in the heating roller 14 at the center thereof, as illustrated in FIG. 16.

<Mounting and Removing Lamp Cartridge>

How to mount and remove the lamp cartridge 63 will be explained with reference to FIG. 17. When the lamp cartridge 63 or the heating roller 14 described below is to be replaced, a protective pipe 64, which is made of paper or is formed with heat tolerant synthetic resin, is used in the manner illustrated in FIG. 17. The outer diameter of the protective pipe 64 is designed to be approximately same in size as the internal diameter of the holding member 48, and the internal diameter of an internal tube 59*b* in the housing 59. The inner diameter of the protective pipe 64 is designed to be approximately same in size as the outer diameter of the lamp holder 62. The length of the protective pipe 64 is designed to be slightly longer than the distance between the frames 50 and 50 located at both sides.

Figure 17:
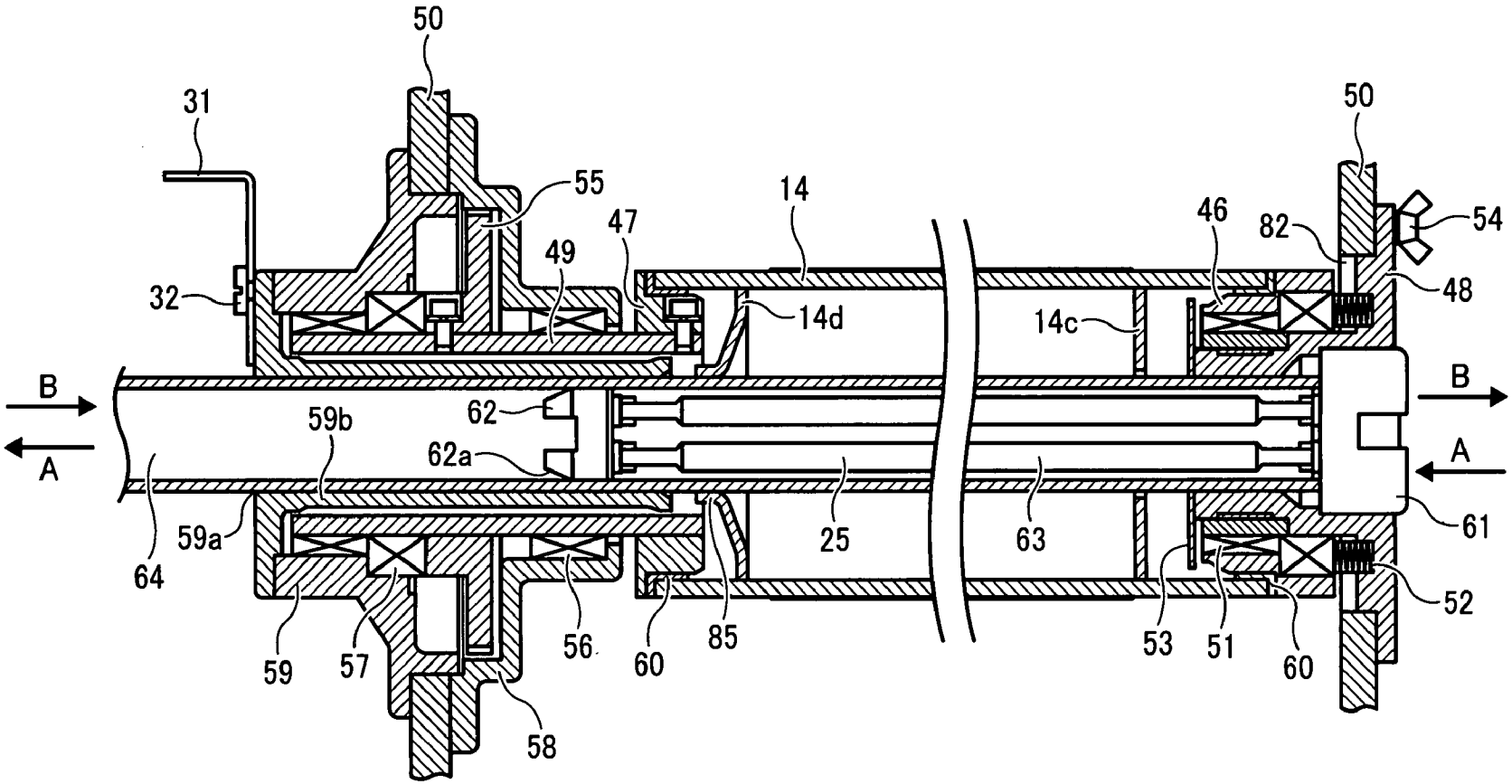
FIG. 17 is a sectional view of the heating roller in the embodiment with a protective pipe being mounted thereon.

To insert the lamp cartridge 63 into the heating roller 14, the lamp cartridge 63 is at first inserted into the protective pipe 64 from the lamp holder 62 side, up to where the right end of the protective pipe 64 abuts to an end surface of the other lamp holder 61 (see FIG. 17). The leading edge of the lamp holder 62 has a sloped portion 62*a* to allow the lamp holder 62 to be inserted into the protective pipe 64 more easily.

The lamp cartridge 63 covered with the protective pipe 64 is inserted from the holding member 48 side (from the front side of the printer) as indicated by the arrow A in FIG. 17. The protective pipe 64 passes through the insides of the holding member 48, the absorber 14*c*, the absorber 14*d*, and the internal tube 59*b* in the housing 59.

Figure 18:
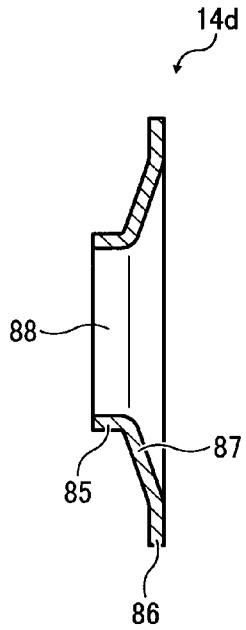
FIG. 18 is a sectional view of one absorber in the embodiment.

FIG. 18 is a sectional view of the absorber 14*d*. The entire absorber 14*d* is approximately disk-shaped, and includes at the center a tubular sliding portion 85 extending in the axial direction of the heating roller 14. The sliding portion 85 and a periphery portion 86 of the absorber 14*d* are connected by a sloped portion 87 slightly sloping so that the sliding portion 85 is located closer to the opening of the heating roller 14 than the periphery portion 86, as illustrated in FIG. 17. An insertion hole 88 is formed on inner side of the sliding portion 85. The inner diameter of the insertion hole 88 is designed to be approximately same in size as the outer diameter of the protective pipe 64. In this embodiment, the axial length of the sliding portion 85 is set as 5 to 10 millimeters.

As described above, the internal diameters of the hollow portion of the holding member 48, the insertion hole 88 of the absorber 14*d*, and the internal tube 59*b* of the housing 59 are designed to be approximately same in size as the outer diameter of the protective pipe 64, and the absorber 14*d* has the sloped portion 87 sloping toward the insertion hole 88. Therefore, the protective pipe 64 (lamp cartridge 63) can be inserted smoothly into the heating roller 14 without being wobbled in the inserting direction.

The insertion of the lamp cartridge 63 stops where the outer circumference of the lamp holder 61 abuts to the holding member 48. At this time, the leading edge of the protective pipe 64 in the insertion direction protrudes to the outside of the machine from the housing 59. Therefore, the protective pipe 64 can be pulled out of the heating roller 14 in the direction of the arrow A by holding the protruding portion with a hand, and mounting of the lamp cartridge 63 is completed.

To remove the lamp cartridge 63 from the heating roller 14, the protective pipe 64 is inserted to a penetrating hole 59*a* of the housing 59 from the rear side of the printer in the direction pointed by the arrow B in FIG. 17, and is guided by the internal tube 59*b* in the housing 59, the sloped portion 62*a* on the lamp holder 62, the sliding portion 85 (insertion hole 88) on the absorber 14*d*, and the holding member 48, up to where the leading edge of the protective pipe 64 in the insertion direction abuts to the end surface of the lamp holder 61. In this manner, the lamp holder 62 is housed inside the protective pipe 64. The lamp cartridge 63 can be removed by further inserting the protective pipe. 64, so that the lamp cartridge 63 is pressed out along with the protective pipe 64 in the direction pointed by the arrow B.

In this manner, by inserting or removing the lamp cartridge 63 covered by the protective pipe 64, the heater lamps 25 can be protected from getting damaged while the lamp cartridge is handled. A paper tube is suitable for the protective pipe 64 because a paper tube has a heat insulating property, and a certain level of mechanical strength, and also is cheap and can be procured easily.

The sloped portion 87 provided on the absorber 14*d* not only functions as a guide when inserting the protective pipe 64 in the direction of the arrow A, but also to alleviate a temperature difference on the surface of the heating roller 14. In other words, the surface temperature at the edges of the paper-passing area Aw (see FIG. 16) on the heating roller 14 tend to be lower than that at the center of the paper-passing area Aw, and a temperature difference tends to occur between the edges and the center.

Therefore, as illustrated in FIG. 16, the absorber 14*d* is disposed immediately outside of the paper-passing area Aw on the heating roller 14, and the absorber 14*d* has the sloped portion 87 extending toward the opening of the heating roller 14 (the end of the heater lamps 25) so that the heat generated at the end of the heater lamps 25 is collected at the sloped portion 87. Thus, the surface temperature at the edge of the paper-passing area Aw of the heating roller 14 increases and the temperature difference on the surface of the heating roller 14 can be alleviated advantageously.

In the embodiment, the sloped portion 87 is arranged on the absorber 14*d*. Alternatively, the sloped portion may be arranged on the absorber 14*c*.

<Structure of Heating Roller Replacement Aid>

The replacement aid for the heating roller 14 will now be explained. The replacement aid according to the embodiment includes a guiding shaft 30, an assisting unit 40, and supporting roller members 70.

Figure 1:
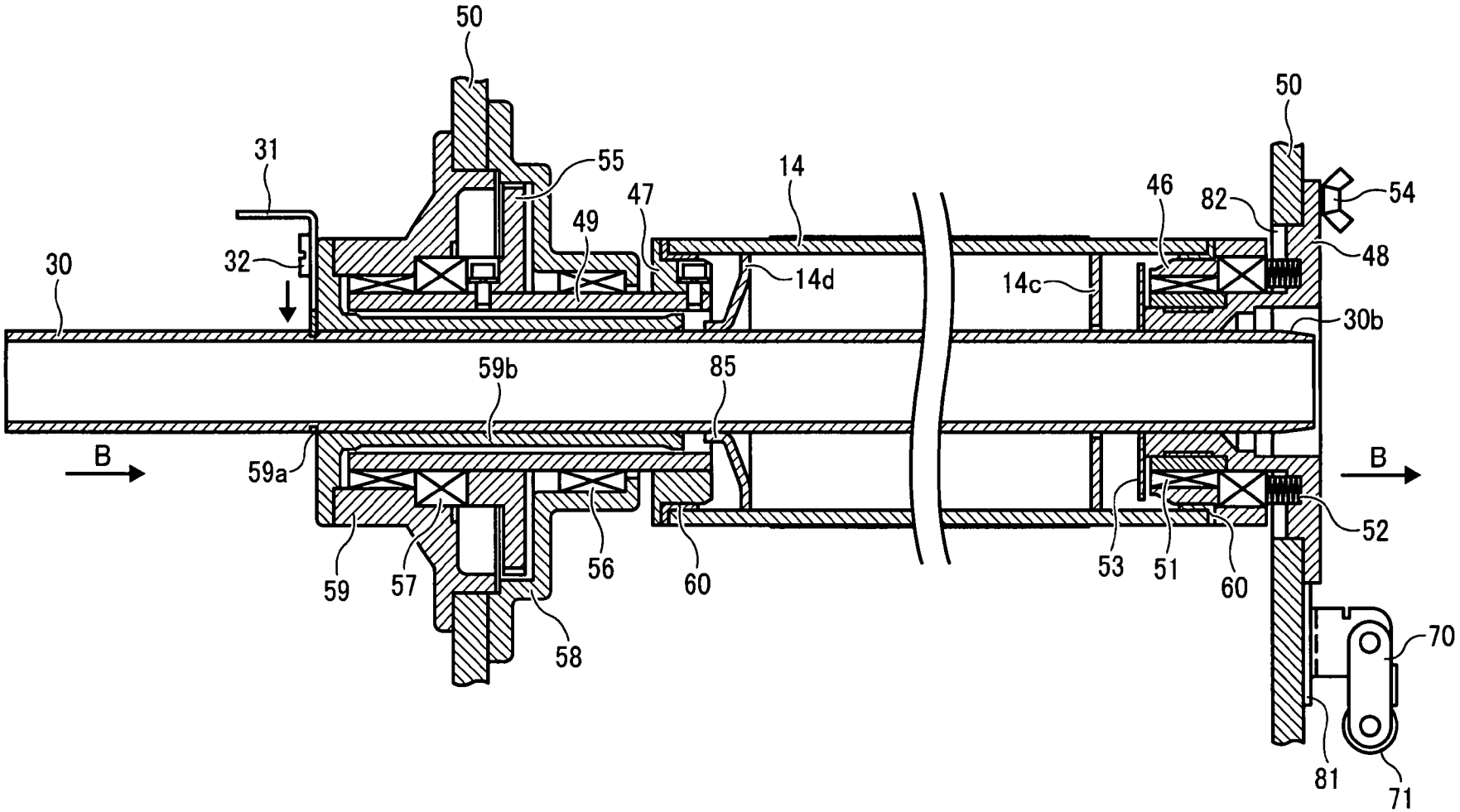
FIG. 1 is a sectional view of a guiding shaft inserted in a heating roller in an embodiment of the present invention.

The guiding shaft 30 is a straight pipe made of a rigid material such as aluminum (metal). The length of the guiding shaft 30 is slightly longer than the distance between the right and the left frames 50 and 50, as illustrated in FIG. 1. The outer diameter of the guiding shaft 30 is approximately same in size as the internal diameter of the holding member 48, the inner diameter of the sliding portion 85 on one of the absorbers 14*d* (see FIG. 18), and the inner diameter of the internal tube 59*b* in the housing 59. An engaging groove 30*a* is formed circumferentially on the guiding shaft 30 near the trailing edge thereof in the insertion direction (see FIG. 2).

Figure 2:
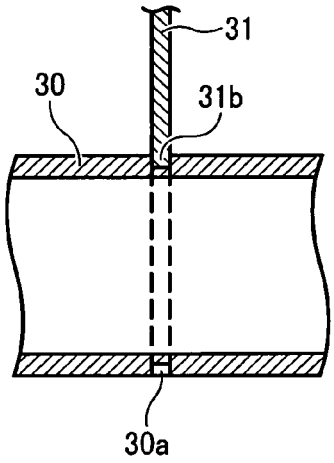
FIG. 2 is an enlarged partial sectional view of an engagement between the guiding shaft and a stopper in the embodiment.
Figure 3:
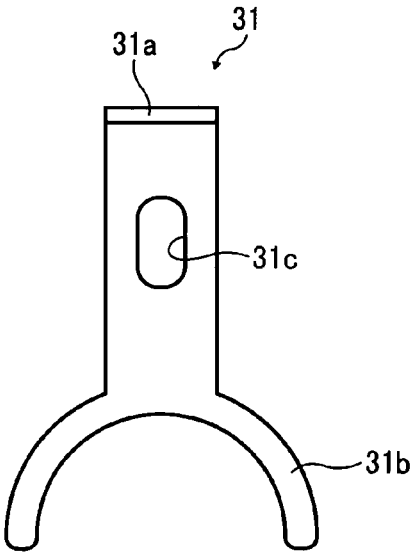
FIG. 3 is an enlarged front view of the stopper in the embodiment.
Figure 4:
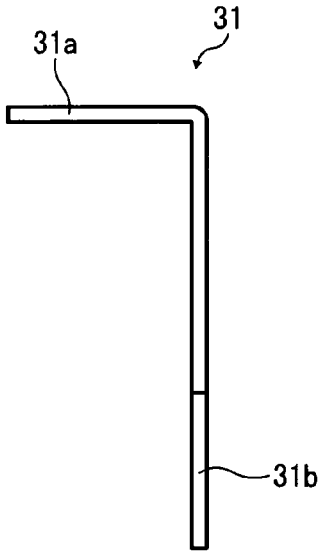
FIG. 4 is an enlarged side view of the stopper in the embodiment.

A plate-like stopper 31 for fastening (locking) the guiding shaft 30 is held on the side of the housing 59 (the rear side of the printer) in a slidable manner by a pin 32. FIG. 2 is an enlarged partial sectional view of an engagement between the guiding shaft 30 and the stopper 31. FIG. 3 is an enlarged front view of the stopper 31. FIG. 4 is an enlarged side view of the stopper 31.

As illustrated in FIGS. 3 and 4, a knob 31*a* bent horizontally is arranged at the top end of the stopper 31. An engaging piece 31*b* extending in an approximate semi-circular shape is arranged on the bottom end of the stopper 31. A sliding groove 31*c* extending in the vertical direction is arranged between the knob 31*a* and the engaging piece 31*b*.

The knob 31*a* is used to bring up or down the stopper 31. The engaging piece 31*b* is engaged with the engaging groove 30*a* on the guiding shaft 30 to fasten (lock) the guiding shaft 30. The pin 32 is inserted in the sliding groove 31*c*. The inner diameter of the semi-circular engaging piece 31*b* is designed to be approximately same in size as the inner diameter of the bottom surface of the engaging groove 30*a* on the guiding shaft 30.

As disclosed in the embodiment, the engaging groove 30*a* is formed extending circumferentially on the guiding shaft 30, and the stopper 31 is formed to include the engaging piece 31*b* extending in an approximate semi-circular shape. Therefore, the guiding shaft 30 can be freely inserted without limitation to the inserting direction of the guiding shaft 30 with respect to the stopper 31, as well as can be reliably fixed (lock) with the inner circumference of the engaging piece 31*b*.

Because the stopper 31 is used to fix (lock) the guiding shaft 30 at a predetermined position, the heating roller 14 described later, the holding member 48, and the assisting unit 40 can be inserted and removed smoothly without causing the guiding shaft 30 to wobble.

A sloped surface 30*b* is formed on the outer circumference of the guiding shaft 30 at the leading edge thereof in the insertion direction, to allow the assisting unit 40, for example, to be inserted smoothly. When the guiding shaft 30 is fixed to a predetermined position, the leading edge of the guiding shaft 30 in the insertion direction (the sloped surface 30*b*) protrudes slightly from the side of the frame 50 (see FIG. 5).

Figure 6:
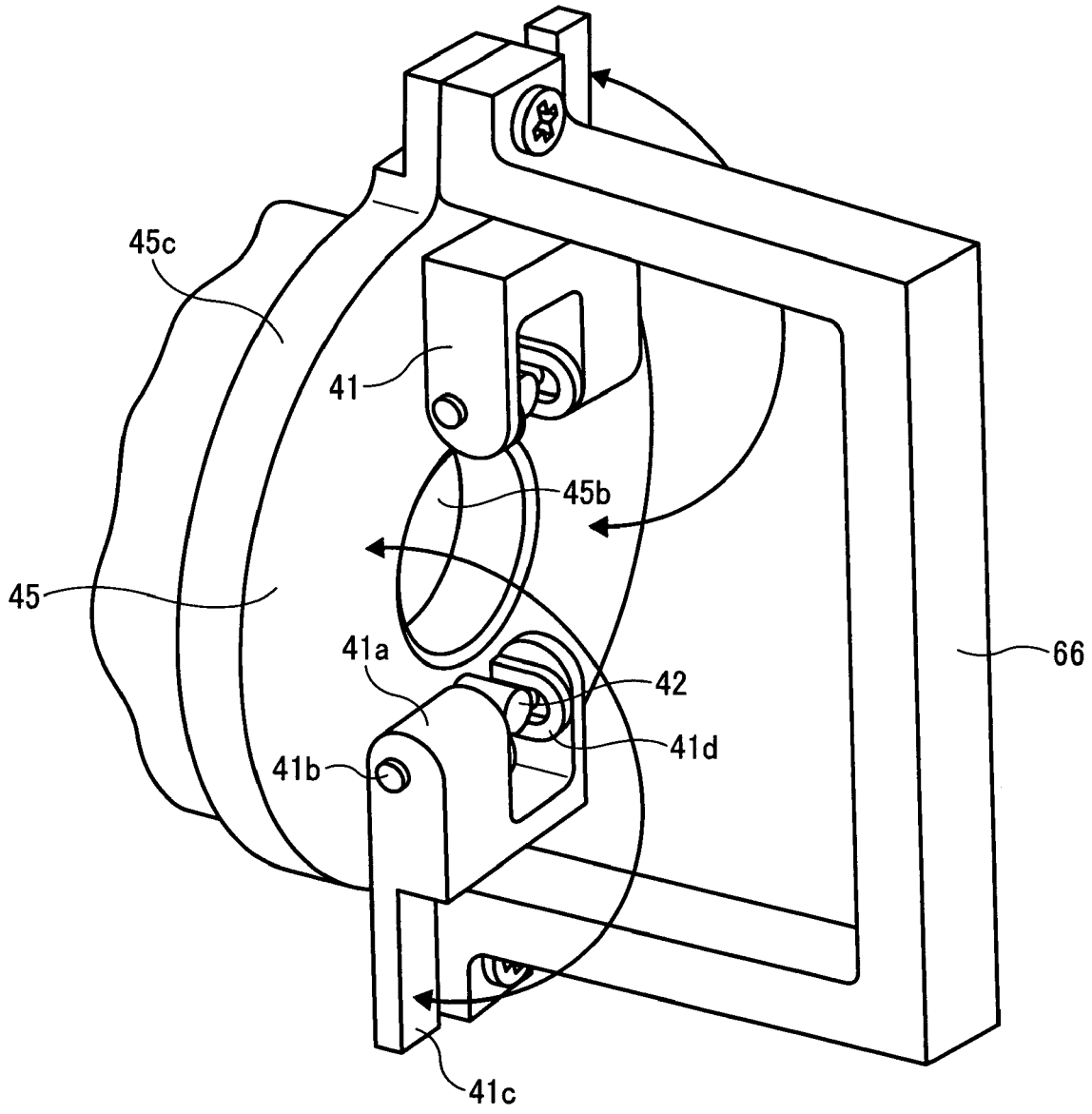
FIG. 6 is a perspective view of a part of an assisting unit in the embodiment.
Figure 7A:
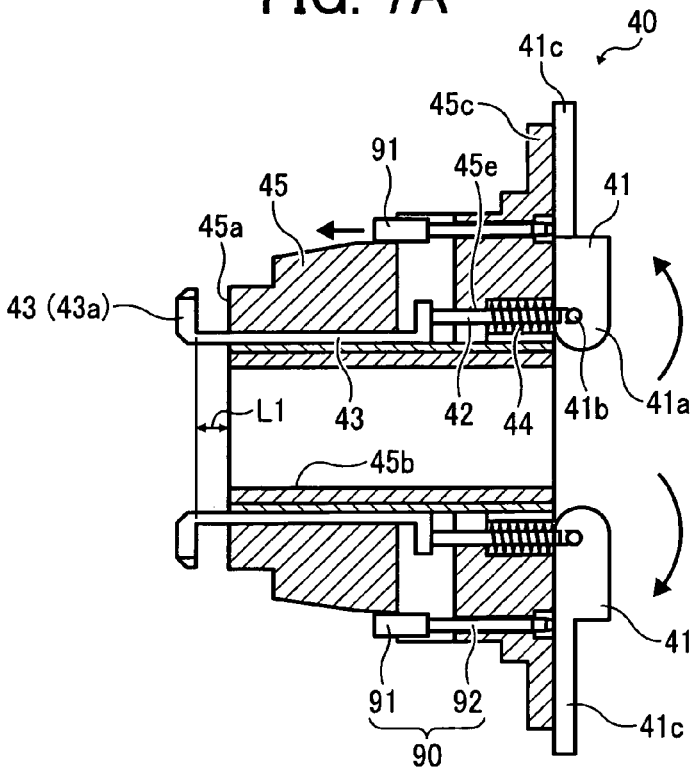
FIG. 7A is a sectional view of the assisting unit with levers on two latches opened outwardly with respect to each other.
Figure 7B:
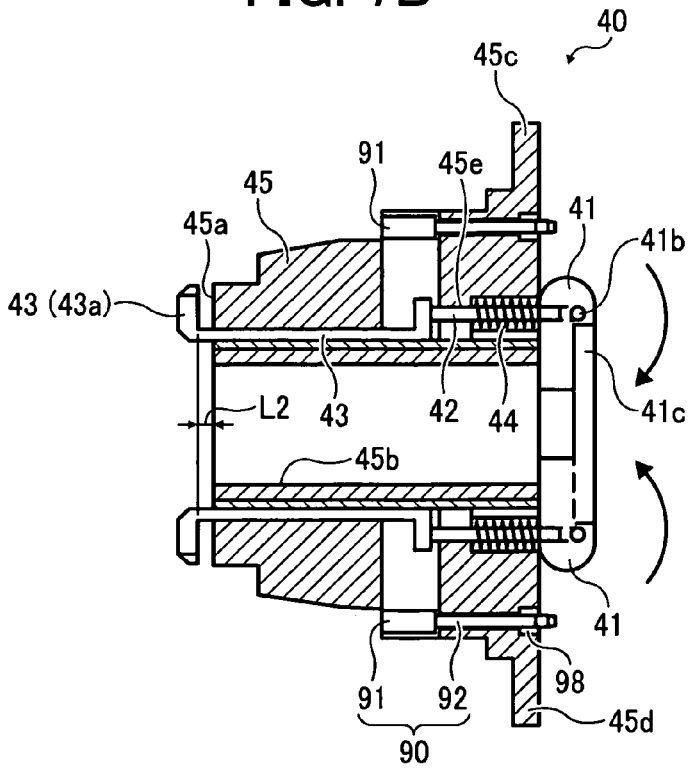
FIG. 7B is a sectional view of the assisting unit with the levers on the two latches rotated inwardly with respect to each other.

As illustrated in FIGS. 6, 7A and 7B, the assisting unit 40 includes a unit body 45, two latches 41 arranged rotatably on a side of the unit body 45, shafts 42 for transferring movements of the latches 41 to holders 43, the holders 43 in each of which one end is coupled to the shafts 42 and the other end is bent outwardly, coil-like springs 44 for absorbing the tolerance of the components to secure fastening of the heating roller 14, a handle 66 attached to the side of the unit body 45, and push pins 90 (see FIGS. 7A and 7B).

A penetrating hole 45*b* penetrating along the axial direction is provided at the center of the unit body 45. The inner diameter of the penetrating hole 45*b* is designed to be approximately same in size as the outer diameter of the guiding shaft 30. A flange 45*c* is formed on one side of the unit body 45.

The two latches 41 are same in shape. Each of the latches 41 includes a semi-cylindrical rotating portion 41*a* formed on one end, an shaft 41*b* arranged inside the rotating portion 41*a* eccentrically in the thickness direction of the rotating portion 41*a*, and a lever 41*c* arranged on the opposite side of the rotating portion 41*a*. These two latches 41 are attached to the unit body 45 so as to face each other with the penetrating hole 45*b* interposed therebetween.

As illustrated in FIGS. 7A and 7B, one end of the shaft 42 is coupled to the shaft 41*b* of the latch 41. On the other end opposing to the end of the holder 43 coupled to the shaft 42 is provided a nipping piece 43*a*, which is bent so as to face to an inner surface 45*a* of the unit body 45.

The coil-like spring 44 is interposed between a stepped spring receiving portion 45*e* arranged on the unit body 45 and the latch 41. The shaft 42 is inserted in the spring 44, and the latch 41 is constantly biased outwardly by resilience of the spring 44. The latch 41 is provided with a retaining unit 41*d* having a U shape laterally (see FIG. 6).

Figure 8:
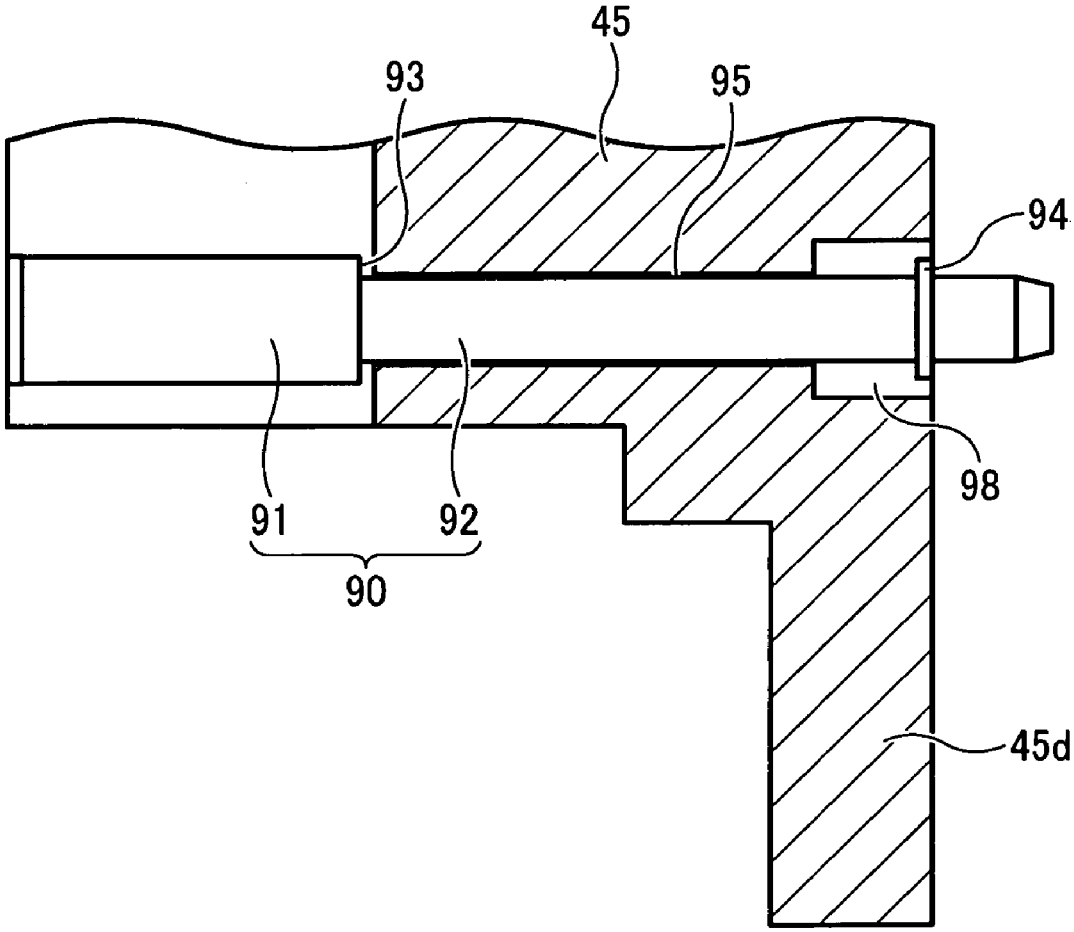
FIG. 8 is an enlarged sectional view around a push pin in the assisting unit.

The push pin 90 includes a large diameter portion 91 facing to the end surface of the heating roller 14 and a small diameter portion 92 facing to the lever 41*c* on the latch 41, as illustrated in FIGS. 7A, 7B and 8. A stepped portion 93 is formed on the boundary between the large diameter portion 91 and the small diameter portion 92. A retaining ring 94 is fastened near the head of the small diameter portion 92.

As illustrated in FIG. 8, the small diameter portion 92 of the push pin 90 is inserted into a penetrating hole 95 arranged in the unit body 45, and is disposed movably along the axial direction of the heating roller 14 by guidance of the penetrating hole 95. A sunken cutout 98 having an inner diameter larger than the outer diameter of the retaining ring 94 is formed on the end of the penetrating hole 95 facing to the latch 41.

The stepped portion 93 of the push pin 90 faces to one of the opening ends of the penetrating hole 95, and the retaining ring 94 faces to the bottom surface of the sunken cutout 98. In this manner, the push pin 90 is prevented from falling out of (being disengaged from) the unit body 45 carelessly.

Figure 9A:
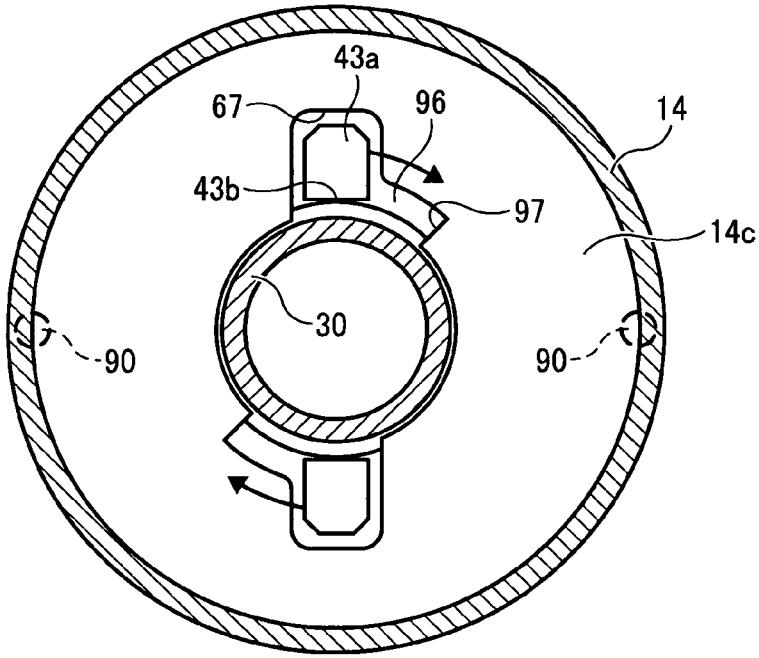
FIG. 9A is a schematic of a relationship between an absorber and nipping pieces on holders taken along an arrow X-X in FIG. 10, with the assisting unit inserted in the heating roller.
Figure 9B:
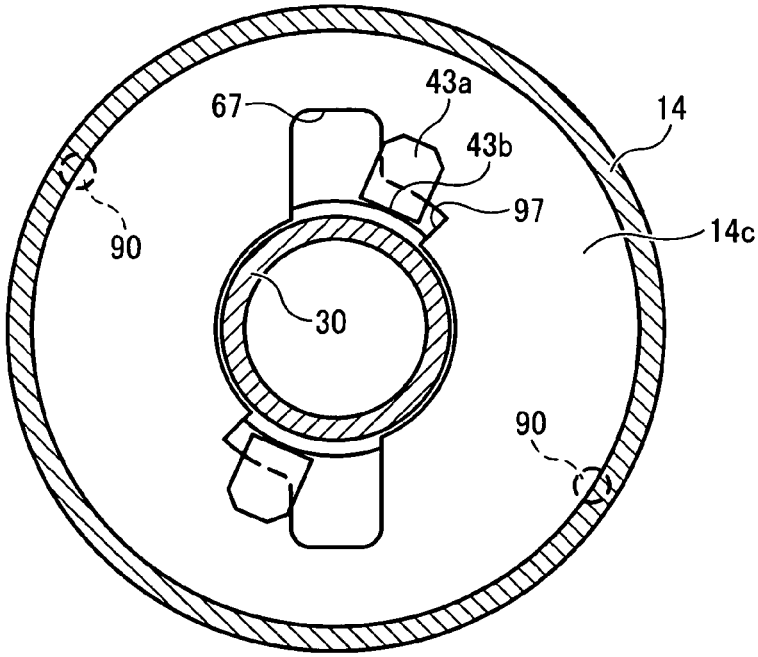
FIG. 9B is a schematic of the relationship between the absorber and the nipping pieces on the holders taken along the arrow X-X in FIG. 10, just before the assisting unit is attached to the absorber.

The push pins 90 are arranged at positions facing to the end surface of the heating roller 14 via rings 60 (not illustrated), as illustrated by the small circles drawn denoted by the dotted lines in FIGS. 9A and 9B, and facing to the lever 41*c* on the latches 41 as illustrated in FIG. 7A.

As illustrated in FIG. 7B, the push pins 90 have a length such that, while the levers 41*c* of the latches 41 are held down inwardly with respect to each other, the small diameter portions 92 of the push pins 90 slightly protrude from an outer surface 45*d* of the unit body 45, and while the levers 41*c* of the latches 41 are held down outwardly with respect to each other as illustrated in FIG. 7A, the small diameter portions 92 of the push pins 90 are pressed by the levers 41*c* on the latches 41, and the large diameter portions 91 of the push pins 90 are caused to protrude from the outer circumference of the unit body 45.

FIG. 7A illustrates the levers 41*c* on the two latches 41 placed outwardly with respect to each other. The shafts 41*b* of the latches 41 are brought near the unit body 45, and therefore, the gap (gap L) between the nipping pieces 43*a* of the holders 43 and the inner surface 45*a* of the unit body 45 becomes large as indicated as L1. The gap L1 is designed to be slightly wider than the thickness of the absorber 14*c*. In this positioning, the push pins 90 are pushed by the levers 41*c* on the latches 41 to cause the large diameter portions 91 to slightly protrude from the outer circumference of the unit body 45.

From this position, if the levers 41*c* on the two latches 41 are rotated down inwardly with respect to each other as illustrated in FIG. 7B, the shafts 41*b* of the latches 41 move away from the unit body 45. As the shafts 41*b* decenter, the shafts 42 and the holders 43 are caused to move. Thus, the gap L between the nipping piece 43*a* of the holder 43 and the inner surface 45*a* of the unit body 45 is reduced to L2. The gap L2 is equal to or smaller in size than the thickness of absorber 14*c*. In this positioning, the levers 41*c* on the latches 41 are separated from the push pins 90. Therefore, the large diameter portions 91 are kept inside the unit body 45, and instead, the small diameter portions 92 protrude from the outer side surface 45*d* of the unit body 45.

By reducing the gap L to the gap L2, the assisting unit 40 is fastened to the absorber 14*c*, and the heating roller 14 is integrated with the assisting unit 40. This allows these components to be removed from or inserted to the fixing unit 12. On the contrary, by increasing the gap L to the gap L1, the assisting unit 40 is released from the absorber 14*c*, and the large diameter portions 91 of the push pins 90 protrude from the outer circumference of the unit body 45. This causes the large diameter portions 91 to press the end surface of the heating roller 14 via the rings 60. The assisting unit 40 is thus separated from the heating roller 14 automatically.

Figure 10:
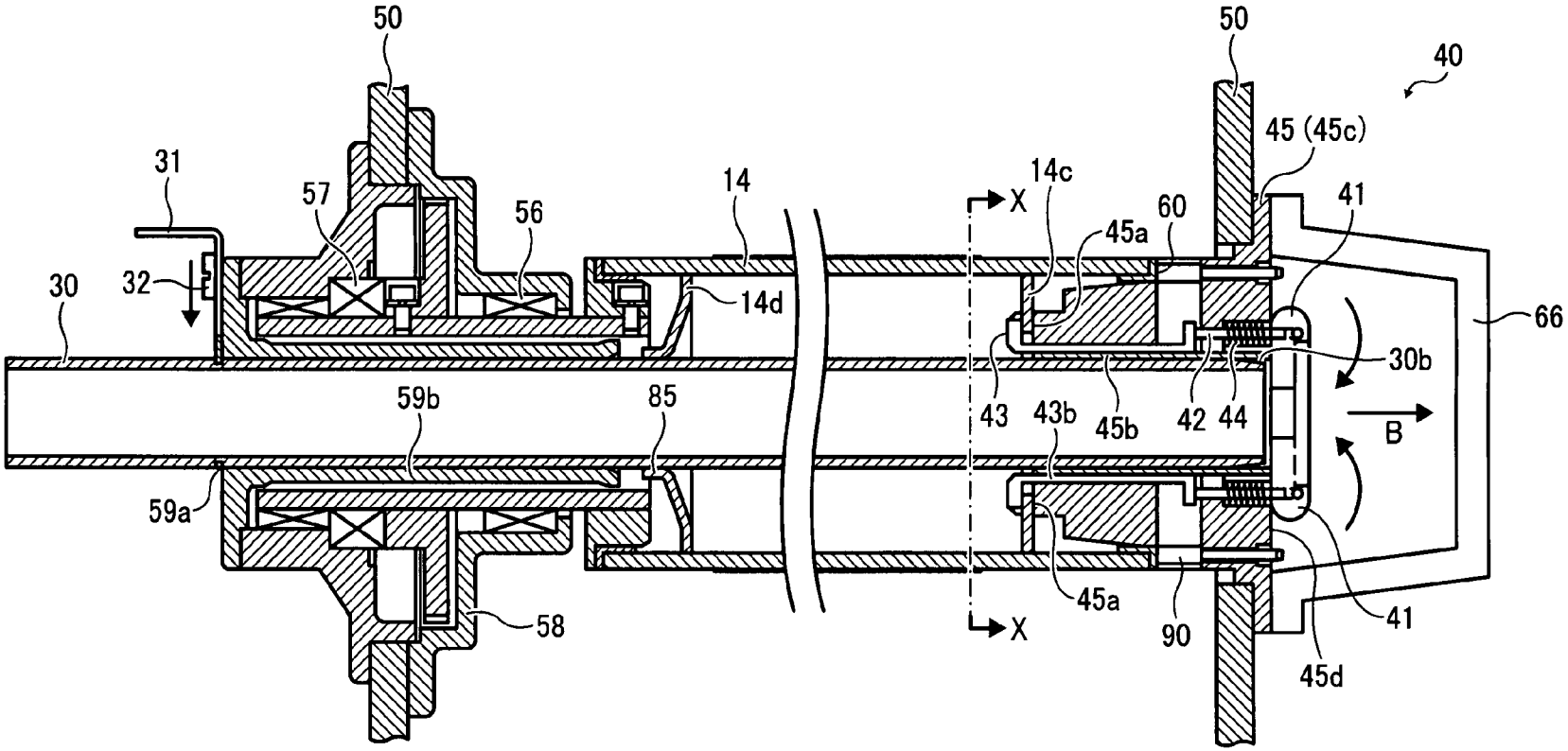
FIG. 10 is a sectional view of the heating roller to which the assisting unit is attached in the embodiment.

FIGS. 9A and 9B are schematics illustrating a relationship between the absorber 14*c* and the nipping pieces 43*a* on the holders 43 taken along the arrow X-X in FIG. 10. FIG. 9A is a schematic illustrating a state where the assisting unit 40 is inserted in the heating roller 14. FIG. 9B is a schematic illustrating a state just before attaching the assisting unit 40 to the absorber 14*c*.

As illustrated in FIG. 9A, two cutouts 67 having the size allowing the nipping pieces 43*a* on the holder 43 to pass through are formed opposite to each other on the inner circumference of the absorber 14*c*. When the assisting unit 40 is inserted into the heating roller 14, the nipping pieces 43*a* of the holders 43 pass through the cutouts 67. Insertion to the absorber 14*c* finishes when the flange 45*c* of the unit body 45 abuts to the outer surface of the frame 50.

As illustrated in FIG. 9A, rotation allowing portions 96 communicatively connected to the cutouts 67 are formed on the center sides of the cutouts 67, along the rotation direction of the assisting unit 40 (the direction pointed by arrows). Stopping end surfaces 97 are formed in the back of the rotation allowing portions 96.

When the handle 66 is held and the assisting unit 40 is rotated in the direction pointed by the arrows in the position illustrated in FIG. 9A, roots 43*b* of the nipping pieces 43*a* (see FIG. 10) get inside of the rotation allowing portions 96. When the leading edges of the roots 43*b* hit the stopping end surfaces 97, the rotation of the assisting unit 40 is stopped. FIG. 9B is a schematic illustrating the leading edges of the roots 43*b* just before hitting the stopping end surfaces 97. When the leading edges of the roots 43*b* hit the stopping end surfaces 97, the nipping pieces 43*a* of the holders 43 come off of the cutouts 67, and face to other part of inner circumference of the absorber 14*c*.

The stopping end surfaces 97 are arranged at positions allowing the assisting unit 40 to stop automatically when the assisting unit 40 is rotated by approximately 30 to 60 degrees (30 degrees in this embodiment) in the direction pointed by the arrows from the position illustrated in FIG. 9A.

When the levers 41*c* on the two latches 41 are rotated inwardly, as illustrated in FIG. 10, with the assisting unit 40 stopped automatically, the nipping pieces 43*a* of the holders 43 are pulled toward the unit body 45 via the shafts 42, and the inner circumference of the absorber 14*c* is nipped between the nipping pieces 43*a* on the holders 43 and the inner surface 45*a* of the unit body 45. In this manner, the assisting unit 40 is fixed to the heating roller 14 with the absorber 14*c* interposed therebetween.

As illustrated in FIGS. 11A to 11F, the supporting roller member 70 includes a supporting roller 71, a first shaft 72 rotatably supporting the supporting roller 71, a roller plate 73 fixing the first shaft 72 on one of free ends thereof, a second shaft 74 arranged on the base end of the roller plate 73, and a holder plate 75 rotatably supporting the second shaft 74.

As described later, the heating roller 14 at a high temperature of approximately 200 degrees Celsius is carried on the supporting rollers 71 when the heating roller 14 is replaced. Therefore, the supporting rollers 71 are highly heat tolerant, and made of the same material or a material of the same system as the surface layer 14*b* of the heating roller 14 (see FIG. 16) so that the surface layer 14*b* is not damaged thereby. In this embodiment, the surface layer 14*b* of the heating roller 14 is formed with a fluorine-based resin such as polytetrafluoroethylene (PTFE) resin, tetrafluoroethylene/perfluoroalkyl-vinyl-ether copolymer (PFA) resin, or tetrafluoroethylene hexafluoropropylene copolymer (fluorinated ethylene propylene (FEP)) resin. The supporting rollers 71 are also made of the same material or a material of the same system (fluorine-based resin in the embodiment).

Not to damage the surface of the heating roller 14 with the supporting rollers 71 when the heating roller 14 is carried on the rotating supporting rollers 71, the supporting rollers 71 are shaped drum-like so that the surface of the heating roller 14 is kept in point contact with the surface of the supporting roller 71.

On one side of the roller plate 73, a hook 76 is formed integrally by bending. A groove 77 into which the hook 76 engaged (fitted) is formed on the holder plate 75 (see FIG. 11E). The width of the groove 77 is set to a size that is approximately same as the thickness of the hook 76. An elongated hole 78, which extends in parallel with the groove 77 and to which the second shaft 74 is inserted, is formed on the holder plate 75. The roller plate 73 is supported thereby in a vertically movable manner, which is described later.

Figure 11A:
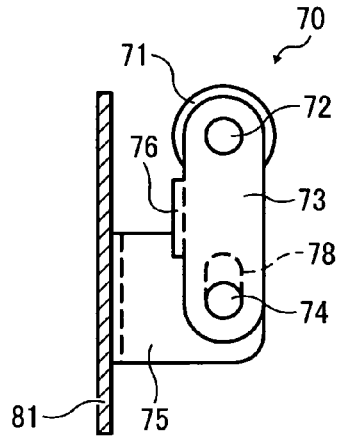
FIG. 11A is a side view of a supporting roller member in the embodiment at a working position.
Figure 11B:
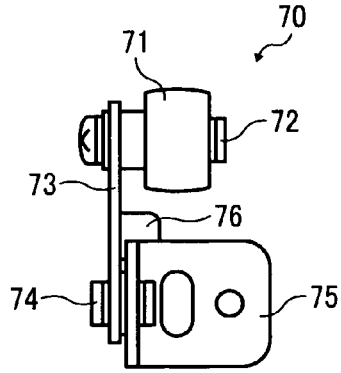
FIG. 11B is a plan view of the supporting roller member in the embodiment at the working position.
Figure 15:
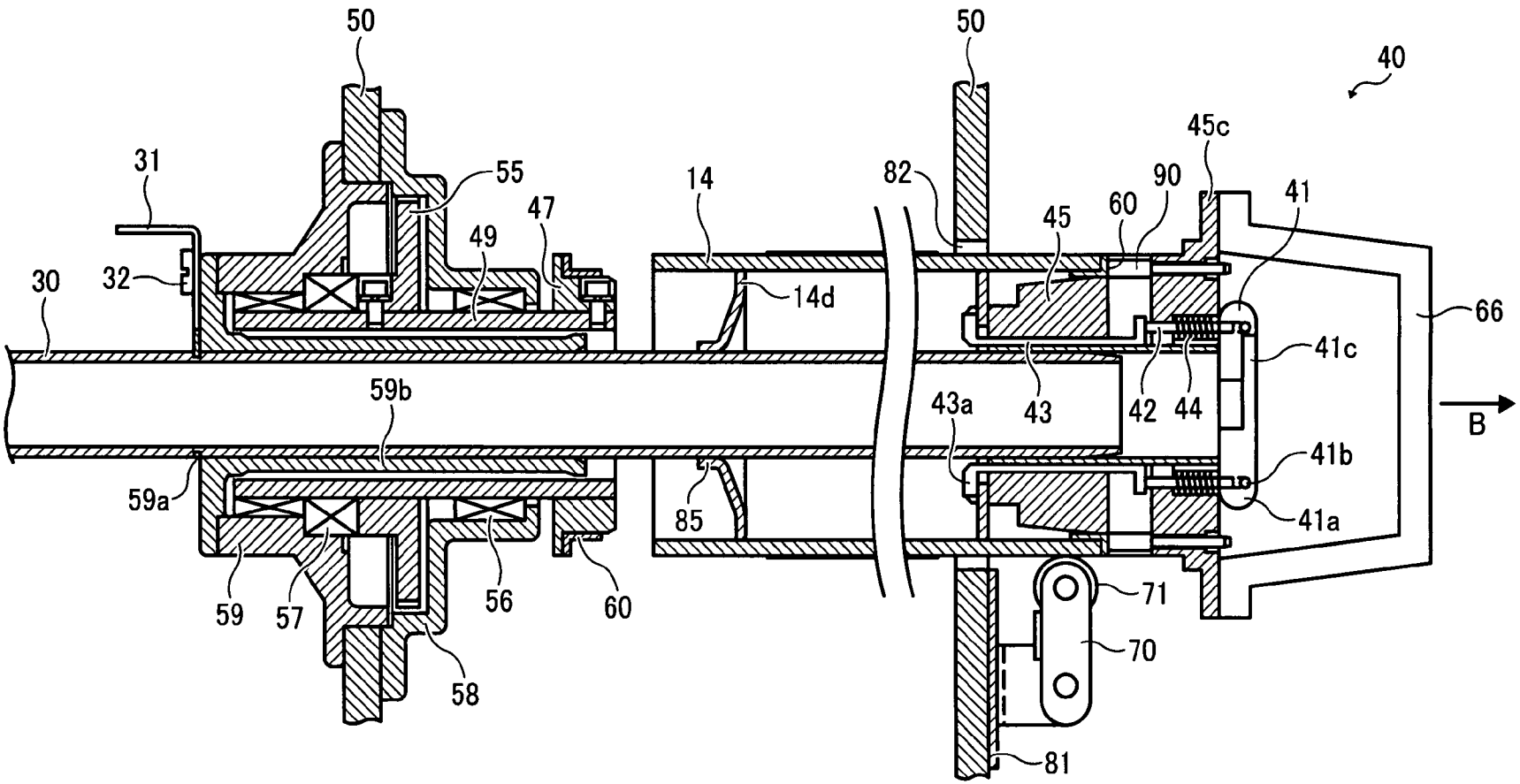
FIG. 15 is a sectional view of the heating roller being pulled out in the embodiment.

FIGS. 11A and 11B are respectively a side view and a front view of positioning of the supporting roller member 70, when the heating roller 14 is pulled out of or inserted into the printer. As illustrated in FIG. 11A, the hook 76 arranged on the roller plate 73 is inserted (locked) in the groove 77 on the holder plate 75 to keep the roller plate 73 upright. Thus, the supporting roller 71 faces a replacement opening 82 arranged on the frame 50, as illustrated in FIG. 15.

Figure 11C:
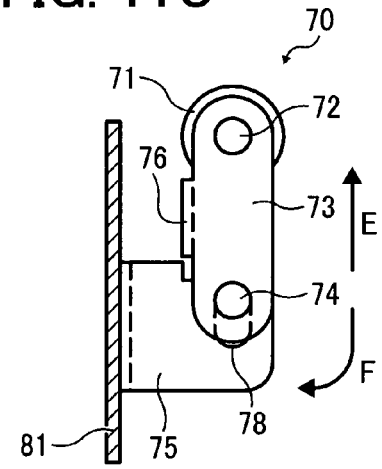
FIG. 11C is a side view of the supporting roller member in the embodiment being moved from the working position toward a standby position.
Figure 11D:
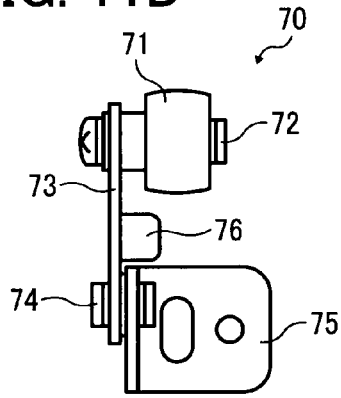
FIG. 11D is a plan view of the supporting roller member in the embodiment being moved from the working position toward the standby position.

FIGS. 11C and 11D are respectively a side view and a front view of the supporting roller member 70 when the supporting roller member 70 is moved from a working position explained above toward a standby position explained below. As illustrated in FIG. 11C, the roller plate 73 is pulled up in the direction pointed by the arrow E to take the hook 76 off of the groove 77 (releasing the lock), and the roller plate 73 is then rotated about the second shaft 74 by approximately 180 degrees in the direction pointed by the arrow F.

Figure 11E:
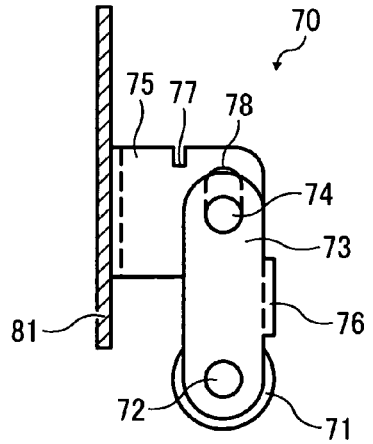
FIG. 11E is a side view of the supporting roller member in the embodiment at the standby position.
Figure 11F:
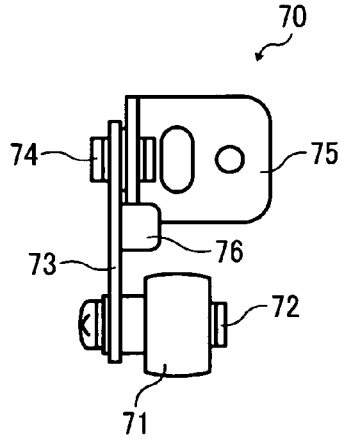
FIG. 11F is a plan view of the supporting roller member in the embodiment at the standby position.

FIGS. 11E and 11F are respectively a side view and a front view of the supporting roller member 70 at the standby position. In this position, the roller plate 73 is hanging from the second shaft 74. Therefore, the supporting roller 71 is located at a lower position, and is at the standby position away from the replacement opening 82 on the frame 50 (see FIG. 1).

Figure 12:
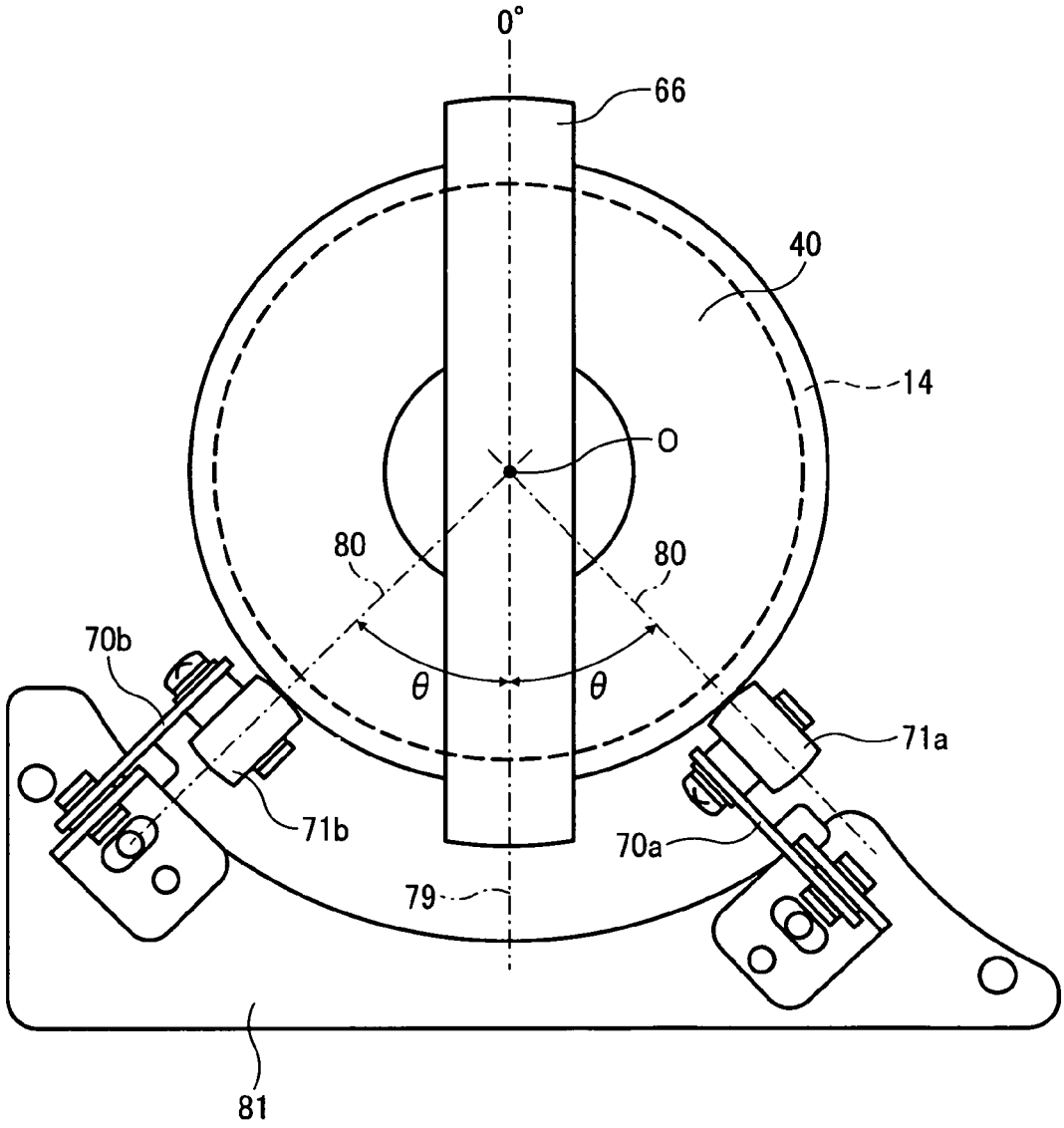
FIG. 12 is a schematic of an arrangement of two supporting roller members with respect to the assisting unit in the embodiment.

FIG. 12 is a schematic showing arrangements of the supporting roller members 70 with respect to the assisting unit 40. In this embodiment, two supporting roller members 70*a* and 70*b* are used, and are arranged at positions near the replacement opening 82 on the frame 50 so that the heating roller 14 can be pulled out smoothly by holding the handle 66 on the assisting unit 40.

It is assumed that a vertical line 79 passing through a center "O" of the heating roller 14 is zero degree as illustrated in FIG. 12, and that the two supporting roller members 70*a* and 70*b* are specifically installed under the heating roller 14. In this case, center lines 80, which are perpendicular to the axes of supporting rollers 71*a* and 71*b*, respectively, cross at an angle (angle θ) between ±30 to ±60 degrees with respect to the vertical line 79, or more preferably between ±40 to ±50 degrees (45 degrees in this embodiment). The supporting roller members 70*a* and 70*b* are arranged at symmetrical positions with respect to the vertical line 79. In this manner, when the heating roller 14 is pulled out with an aid of the assisting unit 40, the supporting roller members 70*a* and 70*b* can stably support the heating roller 14 to eliminate factors of instability without obstructing the operation.

In FIG. 12, the supporting roller members 70*a* and 70*b* are attached to an attaching plate 81 at the symmetrical positions, and the supporting roller members 70*a* and 70*b* are fixed to the outside of the frame 50 via the attaching plate 81 (see FIG. 1).

In this embodiment, the two supporting roller members 70 are arranged under the heating roller 14. In addition, it is also possible to provide one or two more supporting roller members 70 above the heating roller 14. In this case, such supporting roller members 70 should be arranged at positions such that, when the heating roller 14 is pulled out with an aid of the assisting unit 40, such pulling operation is not obstructed thereby, in the same manner as the supporting roller members 70*a* and 70*b* arranged downward. The supporting roller member 70 arranged upward must have a predetermined gap with respect to the heating roller 14 to avoid giving too much constraint to the heating roller 14.

<Steps of Replacing Heating Roller>

Steps of replacing the heating roller 14 will be explained. The heating roller 14 is replaced when the heating roller 14 has ended its life, or is replaced to a different heating roller 14 that can satisfy a need required to the printer.

Figure 14:
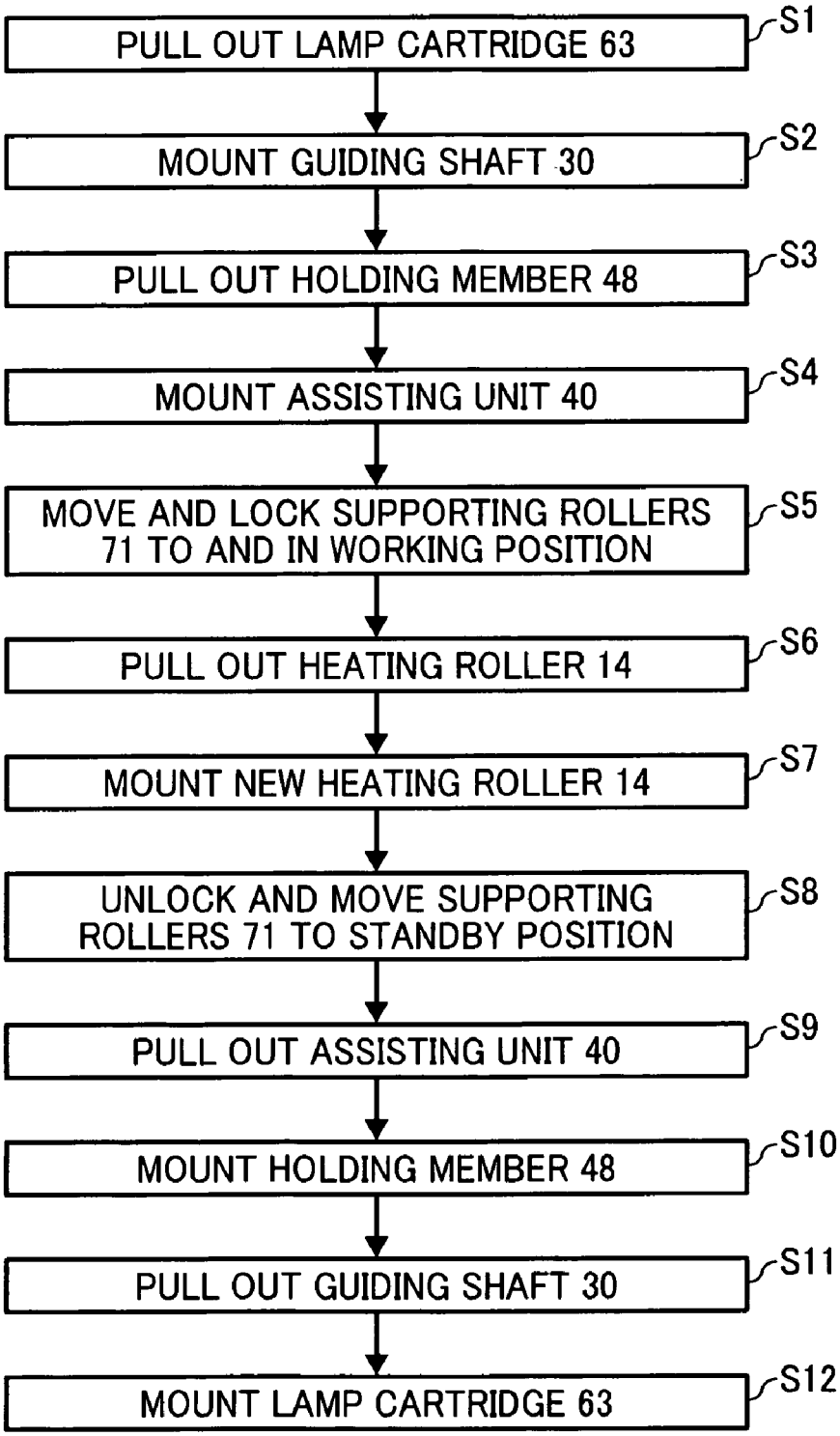
FIG. 14 is a flowchart of steps of replacing the heating roller according the embodiment.

FIG. 14 is a flowchart of steps of replacing the heating roller 14. As illustrated in FIG. 14, at Step S1, the lamp cartridge 63 is pulled out of the heating roller 14 by using the protective pipe 64. This operation is performed in the way that has been explained above with reference to FIG. 17. Therefore, a redundant explanation thereof is omitted herein. Because the lamp cartridge 63 is protected by the rigid protective pipe 64 while the lamp cartridge 63 is in the protective pipe 64, the lamp cartridge 63 is not damaged carelessly during the replacement.

At Step S2, the guiding shaft 30 is inserted into the penetrating hole 59*a* in the housing 59 (from the rear side of the printer), as illustrated in FIG. 1, in the direction pointed by the arrow B. The guiding shaft 30 penetrates while being guided and held by the internal tube 59*b* in the housing 59, the sliding portion 85 of the absorber 14*d*, and the holding member 48. When the guiding shaft 30 is inserted up to a predetermined position, the stopper 31 is inserted to the engaging groove 30*a* on the guiding shaft 30 (see FIG. 2) and mounting of the guiding shaft 30 is completed.

At Step S3, the thumbscrew 54 is loosened and the holding member 48 holding components such as the centering member 46, the shaft bearing 51, the springs 52, and the stopper plate 53 is pulled out in the direction pointed by the arrow B. Because the leading edge of the guiding shaft 30 slightly protrudes from the outer surface of the frame 50, the holding member 48 can be pulled out smoothly while being guided by the guiding shaft 30, without colliding to the edge of the opening of the frame 50. By the centering member 46 parting from the heating roller 14 as the holding member 48 is pulled out, the centering member 46 and the shaft bearing 51 abut to the stopper plate 53 due to resiliency of the springs 52.

Figure 5:
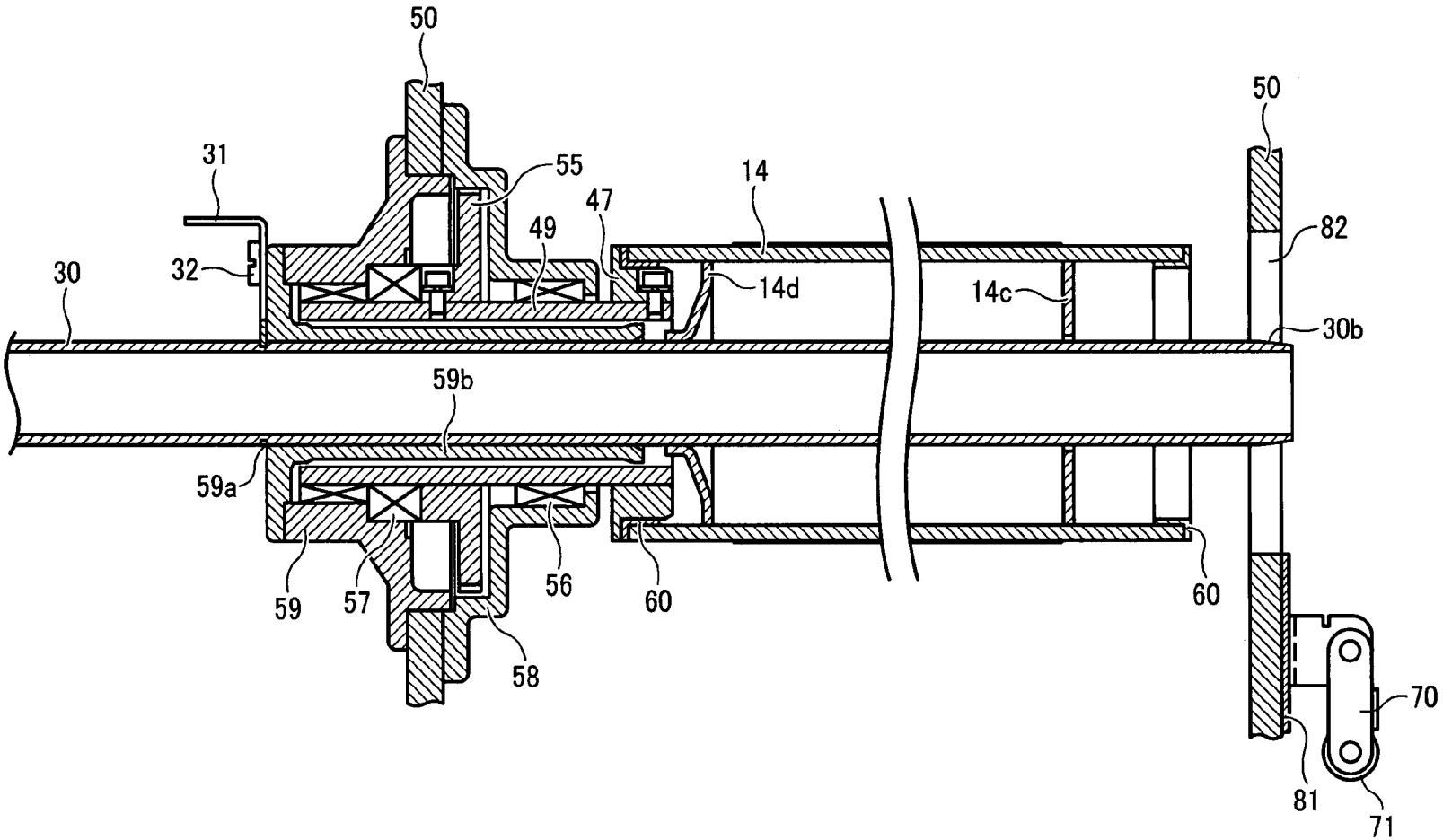
FIG. 5 is a sectional view of the heating roller from which one holding member is pulled out in the embodiment.

Because the supporting rollers 71 on the supporting roller members 70 are at the standby position (lower position) as illustrated in FIG. 1, the removing operation performed by the holding member 48 is not obstructed thereby. FIG. 5 is a schematic showing the heating roller 14 from which the holding member 48 is pulled out.

At Step S4, the assisting unit 40 is inserted to the guiding shaft 30 from the leading edge thereof having the sloped surface 30*b* by holding the handle 66. At this time, as illustrated in FIG. 7A, the levers 41*c* on the latches 41 are kept opened outwardly with respect to each other. Therefore, the gap between the inner surface 45*a* of the unit body 45 and a nipping piece 43*a* of the holder 43 is set to the gap L1 that is wider. The large diameter portions 91 of the push pins 90 protrude from the outer circumference of the unit body 45.

When the assisting unit 40 is inserted to the opening of the heating roller 14, the nipping piece 43*a* of the holder 43 passes through the cutouts 67 on the absorber 14*c*, as illustrated in FIG. 9A, and go inside of the absorber 14*c*. The insertion of the assisting unit 40 stops where the large diameter portions 91 of the push pins 90 abut to the ring 60.

When the assisting unit 40 is rotated in the direction pointed by the arrows in FIG. 9A by holding the handle 66, the rotation of the assisting unit 40 stops where the roots 43*b* of the nipping pieces 43*a* hit the stopping end surfaces 97 of the absorber 14*c*. In this manner, even when the assisting unit 40 is rotated, the push pins 90 remain facing to the end surface of the heating roller 14 as illustrated in FIG. 9B.

When the levers 41*c* of the latches 41 are rotated inwardly with respect to each other as illustrated in FIGS. 7B and 10, the levers 41*c* move away from the push pins 90. The nipping pieces 43*a* on the holders 43 are pulled toward the unit body 45 via the shafts 42, to cause the inner circumference of the absorber 14*c* to be nipped between the nipping pieces 43*a* on the holders 43 and the inner surface 45*a* of the unit body 45. At the same time, the small diameter portions 92 on the push pins 90 protrude from the outer surface 45*d* of the unit body 45. In this manner, the assisting unit 40 is attached to the heating roller 14 via the absorber 14*c*.

At Step S5, the supporting rollers 71 are moved to and locked in the working position. Upon moving and locking the supporting rollers 71, the roller plates 73 illustrated in FIG. 11E are rotated by 180 degrees in the opposing direction from the direction indicated by the arrow F, and the hooks 76 are fitted into the grooves 77. After completing moving the supporting rollers 71, the supporting rollers 71 face to the replacement opening 82 on the frame 50 as illustrated in FIG. 15.

Figure 13:
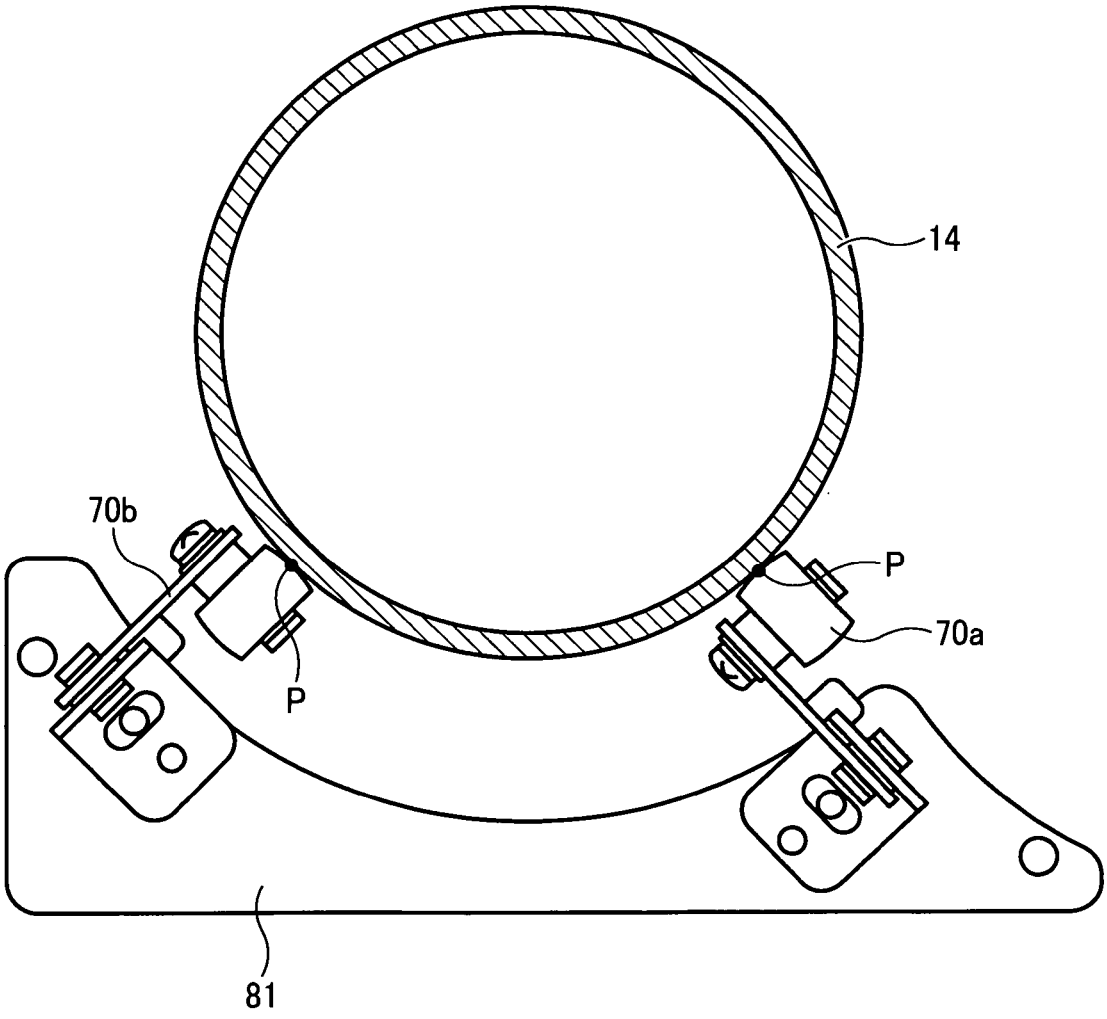
FIG. 13 is a partial sectional view of the heating roller supported by two supporting roller members in the embodiment.

At Step S6, the heating roller 14 that is still in a high temperature is pulled out of the printer by holding the handle 66 on the assisting unit 40. At this time, the guiding shaft 30 is reliably held in the internal tube 59*b* in the housing 59, and the sliding portion 85 on the absorber 14*d* slides on the outer circumference of the guiding shaft 30. A part of the heating roller 14 coming out of the frames 50 is stably supported by the supporting rollers 71*a* and 71*b*, and the supporting rollers 71*a* and 71*b* rotate as the heating roller 14 is pulled out. FIG. 13 illustrates how the heating roller 14 is supported. As illustrated in FIG. 13, the heating roller 14 is supported by the supporting rollers 71*a* and 71*b* at two point contacts "P". In this manner, a part of the heating roller 14 at high temperature of approximately at 200 degrees Celsius does not have to be supported with a hand, to allow the heating roller 14 to be pulled out smoothly and safely.

Even after the heating roller 14 is pulled out, the centering member 47 and the holding member 49 remain at the position as they are. FIG. 15 illustrates the heating roller 14 being pulled out. The standing supporting rollers 71 are positioned closer to the frame 50 than the leading edge of the guiding shaft 30. Therefore, the outer circumference of the heating roller 14 is held on the supporting rollers 71 until the trailing edge of the heating roller 14 in the removing direction comes off of the leading edge of the guiding shaft 30.

At Step S7, the assisting unit 40 is attached to a new heating roller 14 to be replaced (not illustrated), and the assisting unit 40 and the heating roller 14 are mounted by using the guiding shaft 30. The supporting rollers 71*a* and 71*b* are used in mounting as well, and the sliding portion 85 of the absorber 14*d* mounted on the new heating roller 14 slides on the outer circumference of the guiding shaft 30 until the heating roller 14 is smoothly inserted into a predetermined position.

At Step S8, the supporting rollers 71*a* and 71*b* are unlocked, and moved to the standby position. Because unlocking and moving the supporting rollers 71*a* and 71*b* to the standby position are explained earlier with reference to FIGS. 11A to 11F, redundant explanations thereof are omitted herein.

At Step S9, the assisting unit 40 is removed from the heating roller 14. At Step S10, the holding member 48 is mounted using the guiding shaft 30. At Step S11, the stopper 31 is removed and the guiding shaft 30 is pulled out. At Step S12, the lamp cartridge 63 covered with the protective pipe 64 is inserted into the heating roller 14, and then the holding member 48 is pulled out of the heating roller 14 to complete mounting of the lamp cartridge 63.

The step of mounting the new heating roller 14 at Step S7 is a reverse of the step of removing the heating roller 14 at Step S6, and the step of removing the assisting unit 40 at Step S9 is the reverse of the step of mounting the assisting unit 40 at Step S4. At this time, by rotating the levers 41*c* on the latches 41 outwardly, the large diameter portions 91 of the push pins 90 protrude from the outer circumference of the unit body 45 to press the end surface of the heating roller 14 via the ring 60. In this manner, the assisting unit 40 can be separated from the heating roller 14 easily and quickly. The step of mounting the holding member 48 at Step S10 is a reverse of the step of pulling out the holding member 48 at Step S3, and the step of pulling out the guiding shaft 30 at Step S11 is the reverse of the step of mounting the guiding shaft 30 at Step S2. The step of mounting the lamp cartridge 63 at Step S12 is the reverse of the step of pulling out the lamp cartridge 63 at Step S1. Therefore, redundant explanations thereof are omitted herein.

Figure 19:
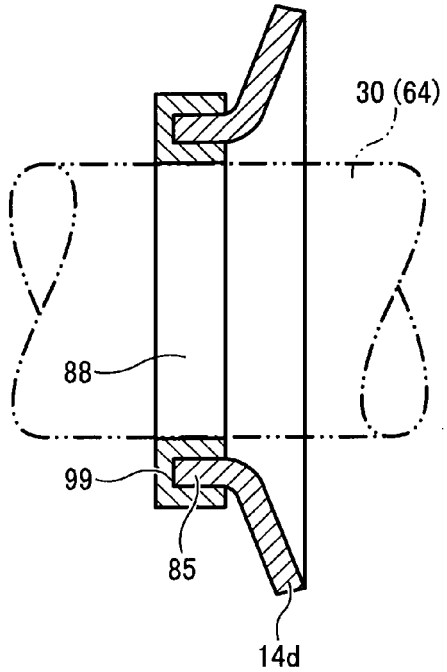
FIG. 19 is an enlarged sectional view of main parts of the one absorber according to another embodiment of the present invention.

FIG. 19 is an enlarged sectional view a part of the absorber 14*d* according to another embodiment of the present invention. As illustrated in FIG. 19, a heat tolerant resin layer 99 is arranged to the sliding portion 85 of the absorber 14*d* at least on the inner circumference of that is brought into sliding contact with the guiding shaft 30 and the protective pipe 64. In this embodiment, the heat tolerant resin layer 99 is made of an injection-molded body, and the injection-molded body is tightly fitted into the sliding portion 85 of the absorber 14*d*. It is also possible to provide coating of heat tolerant resin on the inner circumference of the sliding portion 85 to form the heat tolerant resin layer 99. In this embodiment, the inner diameter of the heat tolerant resin layer 99 is designed to be approximately same in size as the outer diameters of the guiding shaft 30 and the protective pipe 64.

As the heat tolerant resin, polyimide resin, polyamide imide resin, polyphenylene oxide resin, polysulfone resin, or fluorine resin is used, for example. In this manner, by providing the heat tolerant resin layer 99 on the part being brought in sliding contact with the guiding shaft 30 and the protective pipe 64, the guiding shaft 30 and the protective pipe 64 can be inserted and removed more smoothly by slipping property of the heat tolerant resin layer 99, and uncomfortable sliding sound can be eliminated.

Figure 20:
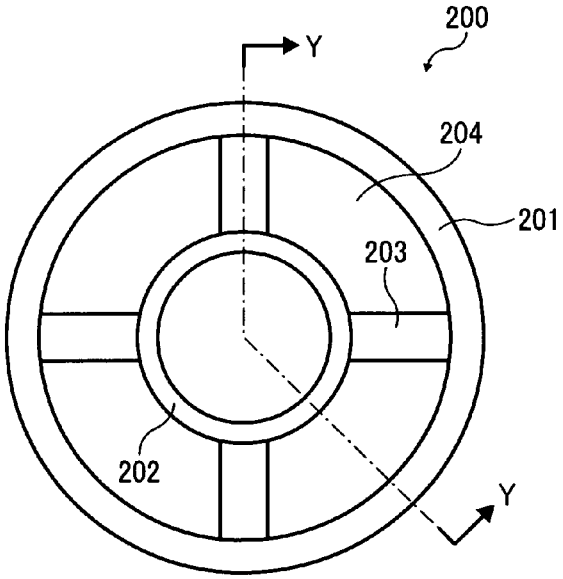
FIG. 20 is a front view of a shaft sliding member according to still another embodiment of the present invention.
Figure 21:
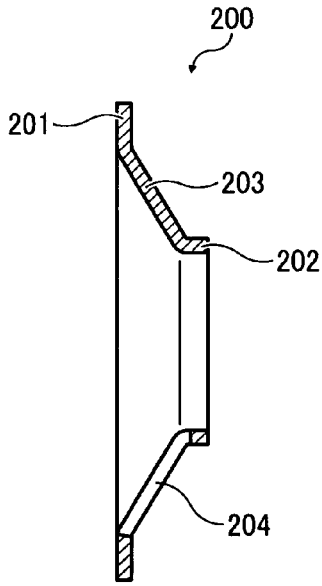
FIG. 21 is a sectional view taken along the line Y-Y in FIG. 20.

FIG. 20 is a front view of a shaft sliding member according to another embodiment of the present invention. FIG. 21 is a sectional view taken along the line Y-Y in FIG. 20. In the embodiment described above, a shaft sliding member also functions as the heat release preventing member (absorber). This embodiment relates to a shaft sliding member that does not function as the heat release preventing member (absorber), and is mounted on the pressing roller 15 not having a heat source inside, for example (see FIG. 23).

A shaft sliding member 200 includes an outer ring 201 fixed on the inner circumference of the pressing roller 15 with an adhesive or the like, a sliding portion 202 into which the guiding shaft 30 is inserted, and a plurality of connecting ribs 203 extending in the radial direction of the shaft sliding member 200 to connect the outer ring 201 and the sliding portion 202. The spaces between the connecting ribs 203 are kept as spaces 204 to reduce the weight of and the amount of material used in the shaft sliding member 200.

The inner diameter of the sliding portion 202 is designed to be approximately same in size as the outer diameter of the guiding shaft 30. As illustrated in FIG. 21, the connecting ribs 203 are sloped from the outer ring 201 to the sliding portion 202 in order to function as a guide when the leading edge of the guiding shaft 30 is inserted into the sliding portion 202. The shaft sliding member 200 is formed of heat tolerant resin, such as polyimide resin, polyamide-imide resin, polyphenylene oxide resin, polysulfone resin, or fluorine resin.

In this embodiment and the previous embodiment, the absorber 14*d* and the shaft sliding member 200 are provided with the cylindrical sliding portions 85 and 202 continuous in the circumferential direction to act as the shaft sliding member. However, the sliding portion does not necessarily have to be continuous in the circumferential direction. For example, the sliding portion may have a plurality of slits along the circumferential direction so as to slide on the outer circumference of the guiding shaft 30 elastically.

Figure 22A:
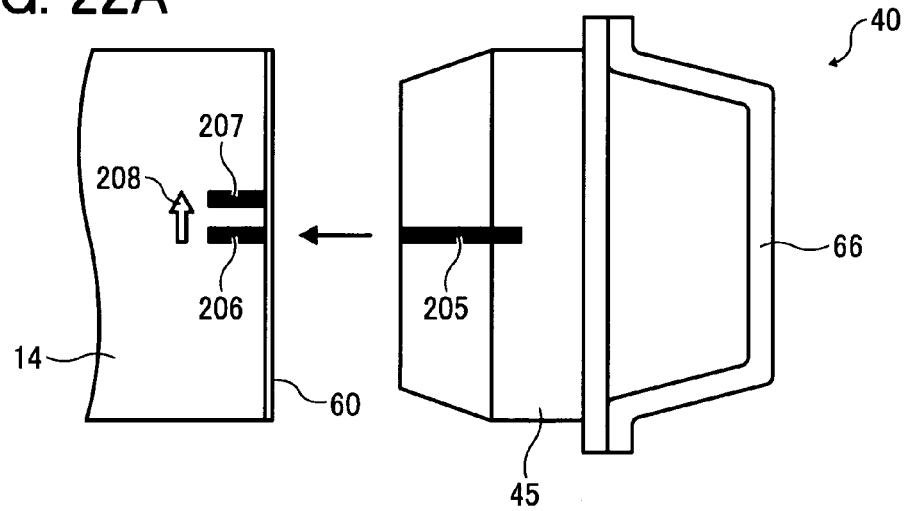
FIGS. 22A to FIG. 22C are partial side views illustrating a situation where the inner circumference of the absorber being nipped by the nipping pieces included in an assisting unit in still another embodiment of the present invention.
Figure 22B:
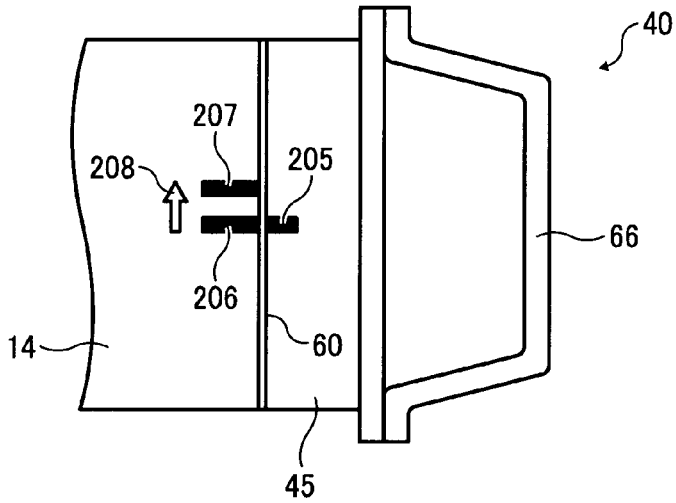
Figure 22C:
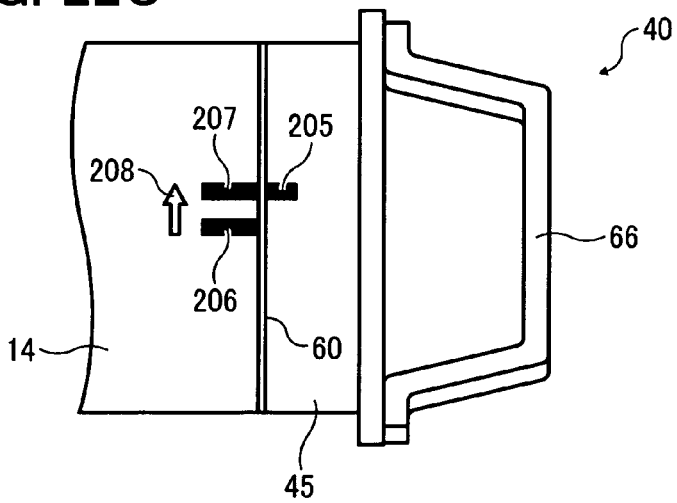

FIGS. 22A to 22C are partial side views illustrating the nipping pieces 43*a* in the assisting unit 40 nipping the inner circumference of the absorber 14*c* according to still another embodiment of the present invention. Because the absorber 14*c* is located inside of the heating roller 14, after inserting the nipping pieces 43*a* in the assisting unit 40 into the cutouts 67 on the absorber 14*c* and rotating the assisting unit 40, it is not possible to check from outside of the heating roller 14 if the nipping pieces 43*a* are apart from the cutouts 67 and face the other inner circumference of the absorber 14*c*.

Therefore, in this embodiment, a unit-side mark 205 is provided by way of printing, for example, on the outer circumference of the unit body 45 in the assisting unit 40 at a position in the inserting-direction on the leading edge side of the assisting unit 40, as illustrated in FIGS. 22A to 22C. At the same time, a first roller-side mark 206, a second roller-side mark 207, and an arrow mark 208 pointing from the first roller-side mark 206 to the second roller-side mark 207 are provided by way of printing, for example, near the opening of the heating roller 14 on the outer circumference thereof. The first roller-side mark 206, the second roller-side mark 207, and the arrow mark 208 are provided at positions on the outer circumference of the heating roller 14 and outside of the paper-passing area Aw (see FIG. 16).

The first roller-side mark 206 is provided at a position so that, when the assisting unit 40 is inserted into the opening of the heating roller 14 so as to bring the unit-side mark 205 on the assisting unit 40 in alignment with the first roller-side mark 206 as illustrated in FIG. 22B, the nipping pieces 43*a* in the assisting unit 40 are exactly inserted into the cutouts 67 on the absorber 14*c* as illustrated in FIG. 9A.

The second roller-side mark 207 is arranged at a position so that, when the assisting unit 40 is rotated in the direction indicated by the arrow mark 208 so as to align the unit-side mark 205 to the second roller-side mark 207, the nipping pieces 43*a* in the assisting unit 40 are parted completely from the cutouts 67 on the absorber 14*c*, and face to the inner circumference of the absorber 14*c* excluding the cutouts 67.

FIGS. 22A to 22C are schematics of such sequential operations. To begin with, as pointed by the arrow in FIG. 22A, the assisting unit 40 is inserted into the opening of the heating roller 14 so that the unit-side mark 205 is aligned with the first roller-side mark 206. As illustrated in FIG. 22B, when the unit-side mark 205 is aligned with the first roller-side mark 206, it can be confirmed that the nipping pieces 43*a* in the assisting unit 40 are exactly inserted into the cutouts 67 on the absorber 14*c*.

The length of the unit-side mark 205 is set so that a part of the unit-side mark 205 remains visible from the opening of the heating roller 14, even when the assisting unit 40 is inserted into the opening of the heating roller 14.

The assisting unit 40 is then rotated in the direction pointed by the arrow mark 208, that is, the direction toward which the rotation allowing portions 96 (see FIG. 9A) are arranged; and the rotation is stopped at the point where the unit-side mark 205 is aligned with the second roller-side mark 207. Because the stopping end surfaces 97 are formed in the back of the rotation allowing portions 96 as described in the above embodiment, it can be confirmed visually that the unit-side mark 205 and the second roller-side mark 207 are aligned, as well as be confirmed with feel that the roots 43*b* of the nipping pieces 43*a* abut to the stopping end surfaces 97.

In the embodiment described above, a cylindrical sliding portion is arranged in the inner circumference of the sliding member. Alternatively, the sliding member may be simpler in shape, where the sliding member is made from a plate-like material, and an insertion hole for inserting the guiding shaft is formed at the center of the sliding member to use circumference of the insertion hole as the sliding portion. It is preferable to round the edge of the opening of the insertion hole so that the guiding shaft can be inserted easily.

In the embodiment described above, upon replacing the heating roller 14, the absorber 14*c* is used to connect the heating roller 14 to the assisting unit 40. Alternatively, the heating roller 14 may be provided with a fitting portion (e.g., a recess, a projection, or a hole) dedicated to the connection to the assisting unit 40, and the heating roller 14 and the assisting unit 40 may be connected together by using the fitting portion dedicated to the connection.

In the embodiment described above, the heating roller 14 is explained to be replaced. However, the present invention can also be applied in replacement of the pressing roller 15 containing or not containing a heat source.

In the embodiment described above, the parting agent or the lubricant is applied on the heating roller 14. Incidentally, the present invention can also be applied to a fixing unit (image forming apparatus) in which the parting agent or the lubricant is applied on the pressing roller 15, or both of the heating roller 14 and the pressing roller 15.

The present invention is structured as described above, and can provide a fixing roller for a fixing unit, a fixing unit, an image forming apparatus, a replacement aid for a fixing roller in a fixing unit, and a method of replacing a fixing roller in a fixing unit that can overcome the disadvantages of the conventional technology and enable a fixing roller to be replaced easily and safely.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing roller used for a fixing unit, wherein the fixing unit has a heating roller and a pressing roller arranged pressably against the heating roller, and heats and presses a recording medium that holds an unfixed toner image on a surface thereof while nipping and conveying the recording medium between the heating roller and the pressing roller to thereby fix a toner image onto the recording medium, wherein the fixing roller is at least one of the heating roller and the pressing roller that is replaceably supported in the fixing unit along an axial direction of the fixing roller, and the fixing roller comprises a sliding member that is formed integrally to an inside of the fixing roller, wherein the sliding member slides on an outer circumference of a roller guiding shaft that is inserted into and removed from the fixing roller upon replacing the fixing roller, and wherein an assisting unit connecting member, to which an assisting unit for removing the fixing roller is removably attachable, is provided at a leading edge portion of the fixing roller in a removal direction, and the sliding member is arranged near an opening of the fixing roller opposing to the assisting unit connecting member, and wherein the assisting unit connecting member comprises:

a cutout through which a nipping piece arranged on the assisting unit is inserted;

a rotation allowing portion that is communicatively connected to the cutout and allows the nipping piece insertable through the cutout to be rotated by a predetermined angle; and a stopping portion that stops rotation of the nipping piece when the nipping piece abuts to an end of the rotation allowing portion .

2. The fixing roller for a fixing unit according to claim 1, wherein the sliding member is approximately disk-shaped, the fixing roller includes a heat source, and the sliding member also functions as a heat release preventing member that prevents radiant heat from the heat source from being released outside the fixing roller.

3. The fixing roller for a fixing unit according to claim 2, wherein the sliding member is arranged outside a paper passing area on the fixing roller.

4. The fixing roller for a fixing unit according to claim 3, wherein the sliding member includes a sloped portion arranged between an outer circumference and an inner circumference of the sliding member, the slope portion being sloped so that the outer circumference of the sliding member is closer to an opening of the fixing roller than the inner circumference.

5. The fixing roller for a fixing unit according claim 1, wherein a heat tolerant resin layer is arranged on an inner circumference of the sliding member.

6. The fixing roller for a fixing unit according to claim 1, wherein the assisting unit connecting member is approximately disk-shaped, the fixing roller includes a heat source, and the assisting unit connecting member is also configured to function as a heat release preventing member that adapted to prevent radiant heat from the heat source from being released outside the fixing roller.

7. The fixing roller for a fixing unit according to claim 6, wherein the assisting unit connecting member is arranged outside a paper passing area on the fixing roller.

8. The fixing roller for a fixing unit according to claim 1, wherein a mark at which the assisting unit is fixed is placed on an end of the fixing roller on an outer circumference thereof.

9. A fixing unit comprising:

a heating roller; and a pressing roller arranged pressably against the heating roller, wherein the fixing unit heats and presses a recording medium that holds an unfixed toner image on a surface thereof while nipping and conveying the recording medium between the heating roller and the pressing roller to thereby fix a toner image onto the recording medium, wherein at least one of the heating roller and the pressing roller is provided as a fixing roller and is supported in the fixing unit in a replaceable manner along an axial direction of the roller, and the fixing roller replaceably supported in the fixing unit is the fixing roller for the fixing unit according to claim 1.

10. The fixing unit according to claim 9, further comprising:

a shaft bearing that rotatably supports one end of the fixing roller to be replaced;

a shaft bearing holding member that holds the shaft bearing; and an inner pipe that is arranged inside of the shaft bearing holding member in order to hold a roller guiding shaft, which guides insertion and removal of the fixing roller while being inserted across the inside of the shaft bearing holding member to inside of the fixing roller upon replacing the fixing roller.

11. The fixing unit according to claim 10, further comprising a lock that prevents a displacement of the roller guiding shaft during replacement of the fixing roller.

12. An image forming apparatus comprising:

a transferring unit that transfers a toner image on an image carrier onto a recording medium; and the fixing unit according to claim 9.

13. The fixing roller for a fixing unit according to claim 1, wherein the fixing roller has, on its outer circumference, a mark arranged at a position so that, when the assisting unit is rotated so as to align a second mark on the outer circumference of the assisting unit to the mark, the nipping piece in the assisting unit is parted completely from the cutout on the unit connecting member and faces the inner circumference of the unit connecting member excluding the cutout.

14. The fixing roller for a fixing unit according to claim 5, wherein the heat tolerant resin layer is formed of any one of polyimide resin, polyamide-imide resin, polyphenylene oxide resin, polysulfone resin, or fluorine resin.

15. A roller replacement aid for a fixing unit, in which at least one of a heating roller and a pressing roller arranged pressably against the heating roller is provided as a fixing roller and is replaced by being pulled out along an axial direction, the roller replacement aid comprising:

a roller guiding shaft that is removably attachable to the fixing unit to penetrate through a sliding member provided inside of the fixing roller to be replaced, and has an outer circumference on which the sliding member slides upon inserting and removing the fixing roller; and an assisting unit that is removably attachable to an assisting unit connecting member arranged to a leading edge portion of the roller to be replaced in a removal direction, and fitted onto an end of the roller guiding shaft to allow the fixing roller to be inserted and removed, wherein the assisting unit connecting member comprises:

a cutout through which a nipping piece arranged on the assisting unit is inserted;

a rotation allowing portion that is communicatively connected to the cutout and allows the nipping piece insertable through the cutout to be rotated by a predetermined angle; and a stopping portion that stops rotation of the nipping piece when the nipping piece abuts to an end of the rotation allowing portion.

16. The roller replacement aid for a fixing unit according to claim 15, wherein the assisting unit connecting member is arranged inside the roller to be replaced near an opening end thereof and also functions as a heat release preventing member.

17. The roller replacement aid for a fixing unit according to claim 15, wherein the assisting unit further comprises:

a nipping unit that nips the assisting unit connecting member of the fixing roller to be replaced; and an operating unit that allows the nipping unit to perform nipping operation.

18. A method of replacing a fixing roller in a fixing unit in which at least one of a heating roller and a pressing roller arranged pressably against the heating roller is provided as a fixing roller and is replaced by being pulled out along an axial direction thereof, the method comprising:

inserting a roller guiding shaft to be mounted so as to penetrate through a sliding member arranged inside of the fixing roller to be replaced;

pulling out a holding member, which has a shaft bearing rotatably supporting one end of the fixing roller to be replaced, along the roller guiding shaft;

connecting an assisting unit to an assisting unit connecting member arranged to a leading edge of the fixing roller in a removal direction, by inserting the assisting unit along the roller guiding shaft;

pulling out the fixing roller connected to the assisting unit by allowing the fixing roller to slide on an outer circumference of the roller guiding shaft via the sliding member;

connecting the assisting unit to an assisting unit connecting member of a new roller in order to mount the new roller to which the assisting unit is connected, by allowing the new roller to slide on the outer circumference of the roller guiding shaft via the sliding member;

pulling out the assisting unit along the roller guiding shaft with disconnecting the assisting unit from the new roller thus mounted;

mounting a holding member, which has a shaft bearing rotatably supporting one end of the new roller, along the roller guiding shaft; and pulling out the mounted roller guiding shaft, wherein the assisting unit connecting member comprises:

a cutout through which a nipping piece arranged on the assisting unit is inserted;

a rotation allowing portion that is communicatively connected to the cutout and allows the nipping piece insertable through the cutout to be rotated by a predetermined angle; and a stopping portion that stops rotation of the nipping piece when the nipping piece abuts to an end of the rotation allowing portion.

19. The method of replacing a fixing roller in a fixing unit according to claim 18, wherein each of the fixing roller to be pulled out and the new fixing roller to be mounted has a lamp cartridge inside thereof, and the method further comprising:

before the inserting of the roller guiding shaft, pulling out the lamp cartridge from the fixing roller to be replaced together with a protective pipe, which is inserted between the lamp cartridge and the fixing roller to be replaced in order to cover the lamp cartridge, and after the pulling out of the mounted roller guiding shaft, inserting the lamp cartridge into the newly mounted roller with the protective pipe, which is pulled out from the newly mounted roller.

20. The method of replacing a fixing roller in a fixing unit according to claim 19, wherein the protective pipe is a paper pipe.

* * * * *